US005511948A

United States Patent [19]

Suzuki et al.

[11] Patent Number: 5,511,948

[45] Date of Patent: Apr. 30, 1996

[54] ROTOR BLADE DAMPING STRUCTURE FOR AXIAL-FLOW TURBINE

[75] Inventors: Atsuhide Suzuki, Yokohama; Hirotsugu Kodama, Arakawa; Toshio Suzuki, Yokosuka, all of Japan

[73] Assignee: Kabushiki Kaisha Toshiba, Kawasaki, Japan

[21] Appl. No.: 320,545

[22] Filed: Oct. 11, 1994

[30] Foreign Application Priority Data

Feb. 18, 1994 [JP] Japan ..... 6-020948

[51] Int. Cl.[6] ..... F01D 5/22

[52] U.S. Cl. ..... 416/191; 416/217; 416/222

[58] Field of Search ..... 416/193 R, 191, 416/203, 222, 216, 217

[56] References Cited

U.S. PATENT DOCUMENTS

| | | | |
|---|---|---|---|
| 2,315,616 | 4/1943 | Hall | 416/217 |
| 3,734,645 | 5/1973 | Strub | 416/216 |
| 3,751,182 | 9/1974 | Brown | 416/191 |
| 3,837,761 | 9/1974 | Brown | 416/203 |
| 4,451,205 | 5/1984 | Honda et al. | 416/219 R |
| 4,781,532 | 11/1988 | Novacek et al. | 416/217 |
| 4,798,520 | 1/1989 | Partington et al. | 416/219 R |
| 4,884,951 | 12/1989 | Heylan et al. | 416/191 |

FOREIGN PATENT DOCUMENTS

| | | | |
|---|---|---|---|
| 0004808 | 1/1986 | Japan | 416/191 |
| 0207101 | 8/1990 | Japan | 416/217 |
| 4-95603 | 8/1992 | Japan . | |
| 0375392 | 5/1973 | U.S.S.R. | 416/191 |

*Primary Examiner*—F. Daniel Lopez
*Assistant Examiner*—Mark Sgantzos
*Attorney, Agent, or Firm*—Foley & Lardner

[57] ABSTRACT

In an axial-flow turbine, at least one of front and rear side contact surfaces of shrouds (3*a* or 3*b*) of blades (1*a* or 1*b*) with respect to the turbine rotational direction is formed at certain angle with respect to a radial line connecting the rotor center and the contact surface. The shroud (3*a*) of the blade (1*a*) of a first kind is formed in a trapezoidal shape converging radially outward in cross section taken in a plane perpendicular to the turbine axial direction, and the shroud (3*b*) of the blade (1*b*) of a second kind is formed in an inverted trapezoidal shape converging radially inward in the cross section. Further, half of an angle (2α) between the front and rear side contact surfaces of the shrouds (3*a* or 3*b*) is made smaller than a static frictional angle of the contact surface. Since the shroud contact surfaces of two adjacent blades can be kept in pressure contact with each other under all operating conditions, a large dynamic stress reduction and superior damping properties can be obtained without producing excessive initial stresses at the blade airfoil and blade dovetail attachment portion.

13 Claims, 16 Drawing Sheets

ROTOR BLADE DAMPING STRUCTURE FOR AXIAL-FLOW TURBINE

BACKGROUND OF THE INVENTION

1. Field of the Invention

The present invention relates to a rotor blade damping structure for an axial-flow turbine, and more specifically to an improvement in the structure of rotor blades for an axial-flow turbine to reduce dynamic stresses and to obtain superior damping properties.

2. Description of the Prior Art

An axial-flow turbine is driven by fluid flowing between rotor blades arranged in the circumferential direction of a rotor so as to form an annular blade arrangement, and energy is transmitted from the fluid to a rotor shaft through the rotor blades. With the recent trend toward increases in the capacity of electric power plants, the volume of flow has increased more and more and the operating conditions (e.g., operating temperature and pressure) have become more and more severe, with the result that the various forces applied to the rotor blades have increased more and more. These forces inevitably cause various internal stresses such as centrifugal stress, thermal stress, bending stress, torsional stress, etc, in the turbine rotor blades, and sometimes generate violent vibration stresses in the rotor blades independently or in combination. Accordingly, it is an important problem to consider how to cope with blade vibration, that is, how to obtain a large dynamic stress reduction and superior damping properties.

One method of reducing the turbine blade dynamic stress is to link a plurality of adjacent turbine rotor blades together by use of a rigid link member. With this method, however, there is the problem that stress is often concentrated at the linkage or interconnection points between adjacent turbine rotor blades. In addition, a torsional stress is inevitably generated in the rigid link member due to the untwisting of the rotor blades during turbine rotation (by centrifugal force), and this problem must be solved. Further, in the type where holes are formed through the rotor blades to link the blades with wire, for instance, a problem arises in that stress readily concentrates around the holes and the holes undergo corrosion with the elapse of time with resultant accumulation of corroded compositions in the holes. On the other hand, under the present situation wherein turbine units become superannuated more and more in the electric power plants, when the above mentioned link members are used for the turbine rotor blades, the blades cannot be detached easily from the turbine, and there arises another problem in that it is difficult to inspect the quality of the rotor and blade dovetail attachment portions to check the remaining life time.

As another method of reducing dynamic stress of the turbine rotor blades, a snubber structure is also well known wherein a shroud is formed integrally with each blade at the top end thereof in such a way that the shrouds of adjacent blades are brought into contact with one another during turbine rotation. A typical example of this snubber structure will be described in further detail below with reference to FIG. 15.

In FIG. 15, blades 1 are assembled to a rotor 2. A shroud 3 is formed integrally with each blade 1 at the top end thereof. Adjacent shrouds 3 are brought into contact with each other during turbine rotation. These adjacent shrouds 3 are assembled so as to provide a minute gap therebetween (a snubber gap) at rest. During turbine rotation, however, the gap is eliminated by the phenomenon that the twisted blade 1 is untwisted by centrifugal force, and the two adjacent shrouds are brought into pressure contact with each other at the end surfaces thereof, and thus the blade vibration is reduced as a result of a vibration damping properties due to the pressure contact of the shrouds.

FIG. 16 is a view of the blades as seen from the blade top radially inward, in which the dashed lines represent the blades 1 when at rest and the solid lines represent the blades during rotation. As depicted in FIG. 16, the snubber gap existing between two adjacent shrouds 3 during the non-rotating condition is eliminated due to the untwisting of the blades caused by centrifugal force applied to each blade 1, so that the two adjacent shrouds 3 are brought into contact with each other.

FIG. 17 shows a blade 1 represented by a twisted plate for simplicity, in which the solid lines show the blade during rest and the dashed lines show the blade during rotation. That is, when the twisted plate 1 shown by the solid lines is pulled at both ends thereof in two opposite arrow directions A, the twisted plate shown by the solid lines is untwisted to the state shown by the dashed lines. In the same way as above, the blade 1 in FIG. 15 is pulled in the longitudinal direction A during rotation, so that the blade 1 is untwisted.

As described above, in the snubber structure, shrouds assembled so as to provide a minute gap between adjacent shrouds, can be brought into contact with one another by the utilization of the untwisting force of the twisted blades. And the blade dynamic stresses could be reduced by friction of contact.

FIGS. 18(*a*) and (*b*) show another example of the snubber structure, in which FIG. 18(*a*) shows a single blade 1 (dashed line) and a single shroud 3 as seen from the top end of the blade, and FIG. 18(*b*) shows a plurality of blades 1 (dashed lines) and a plurality of shrouds 3 in their assembled state. In FIG. 18(*a*), a contact surface 4 of the shroud 3 has an inclination angle θ1 with respect to the axial direction of the turbine, and the pitch l1 between the two side contact surfaces of the shroud 3 is set to a value slightly larger than a geometrical pitch calculated on the basis of the diameter of the shroud contact surface and the number of blades. On the other hand, in the assembled state shown in FIG. 18(*b*), the blades are twisted to provide a torsional angle θ2 between the blade root portion and the shroud 3 and the pitch between the two side contact surfaces of the shroud 3 is set to a geometrical pitch l2. Therefore, in assembled condition, a surface pressure can be generated between the contact surfaces of two adjacent shrouds 3 due to the untwisting force on the twisted blades, so that the vibration damping properties can be obtained. FIGS. 19(*a*) and (*b*) show still another example of the snubber structure, in which FIG. 19(*a*) shows partially assembled blades as seen from the rotor axial direction. In FIG. 19(*a*), a shroud 3*a* provided for the blade la is formed with two opposite tapered surfaces converging radially outward of the blade 1*a*, and a pair of shrouds 3*b* provided for fixed blades 1*b* adjacent to the blade 1*a* are formed each with two opposite tapered surfaces converging radially inward of the blade 1*b*. FIG. 19(*b*) shows a blade 1*a* as seen along the rotor circumferential direction. In FIG. 19(*b*), a dovetail attachment portion 6*a* of the blade 1*a* is fitted in a groove 5 formed in the circumferential surface of the rotor 2. Further, when assembled, a gap m is given between a dovetail load bearing surface 7*a* of the blade 1 and a grove load bearing surface 8*a* of the rotor 2. In other words, the blade 1*a* is previously assembled to be offset radially inward so that it can be shifted radially outward by centrifugal force generated by the blade 1*a* during rotation. Therefore, when the blade 1*a* is shifted radially outward during rotation, the shroud 3*a* of the blade 1*a* is brought into contact with both the shrouds 3*b* of the blades 1*b*, so that all the shrouds are coupled with each other to form a continuously coupling structure throughout the circumference of the rotor blades.

One of the features of the blades of the snubber structure with respect to vibration is that all the blades arranged on the circumferential surface of the rotor can be continuously coupled in one ring by the coupling structure. In more detail, in the case where a plurality of blades are linked via rigid linking members 9 as shown in FIG. 20(*a*), there inevitably exist vibration modes in which grouped blades vibrate in the same phase together. In particular, the vibration mode in tangential direction of the rotor as shown in FIG. 20(*b*) is a low order vibration mode, and such a tangential mode is low in frequency and has higher dynamic stresses. In the case where all the blades are coupled together throughout the circumference of the rotor, even if an external force is applied to the blades so as to excite this vibration mode, the vibration energies cancel each other within the continuously coupled blades, and therefore there exists the advantage that stress level of tangential mode vibration is reduced against an external force applied to the rotor blades.

In the prior art rotor blade structures, however, there exist various drawbacks as follows:

In the untwist type snubber blade structure shown in FIG. 15, the centrifugal force is small when the rotor rotational speed is low and therefore the untwisting of the blades is small. Consequently there is the problem that the contact surfaces of the shrouds are not brought into pressure contact with one another perfectly, and a large dynamic stress reduction and damping properties cannot be expected.

In particular, when the blade length is large, the blades are designed in such a way that the natural frequency does not match the harmonic frequencies of the rotor rotation speed at the rated rotation speed, because a large exciting force is applied at the resonance of blade natural frequency and harmonic frequency. However, whenever the turbine is started or stopped, it is unavoidable that the rotor natural frequency matches the harmonic frequencies of the rotor rotation speed. When the shrouds are not brought into contact with one another under these conditions, the blades vibrate violently and may be broken in the worst case.

On the other hand, in the case where the blade length is relatively short, the blades are twisted to a small degree, and the untwisting of the blades hardly occurs at the rated rotation speed. In this case, therefore, it is impossible to apply the untwist type snubber structure to the short length blades.

Ideal conditions of the blades are that the blades are always provided with the dynamic stress reduction and damping properties under all circumstances, including acceleration or deceleration or rotation at the rated rotation speed. To achieve the above-mentioned conditions, it is necessary to always keep the snubber gap zero, that is, that adjacent blades are always in contact with one another under any operating conditions.

For that reason, the snubber gap must be kept zero in the assembled state. However, where the contact surfaces of the shrouds are in light contact with each other in the assembled condition, the rotor and blades are both elongated outward in the radial direction by centrifugal force during rotation, so that the overall diameter of the shrouds increases and thereby a slight gap is inevitably produced between two adjacent shrouds. As a result, it becomes impossible to keep the shrouds in contact with each other.

Under the above-mentioned conditions wherein two adjacent contact surfaces of the shrouds are opposed to each other with a slight gap therebetween or in light contact with each other, there exists a possibility that the contact surfaces of the shrouds are damaged, when the shrouds collide against each other, and consequently the contact surfaces are subjected to wear, thus deteriorating the blade reliability.

On the other hand, a large vibration damping properties can be obtained in this snubber structure as long as the snubber contact surfaces are in tight contact with each other with certain pressure. And when the shrouds are stably connected to each other as continuously coupled blades, it is possible to expect an effective vibration damping properties.

In the prior art blades of twisted type as shown in FIGS. 18(*a*) and (*b*), the blades are assembled with a twist produced between the blade root portion and the shroud, so that an initial surface pressure can be generated between the snubber contact surfaces in assembled condition due to elasticity of the airfoil portion. However, the torsional rigidity of the blade is extremely high in general, so that when a required torsional deformation is given to the blade an excessive internal stress is inevitably generated in the blade and the dovetail attachment portion. In particular, in the dovetail attachment portion (at which the blade is fixed to the rotor), the blade is brought into non-uniform (partial) contact with the rotor-side groove due to the torsional deformation of the blade-side dovetail portion, with the result that a high local stress is generated there. In addition, in the case of a blade of small length, in particular, the blade is slightly deformed by twisting, and therefore a larger local stress is generated in the blade dovetail portion. Further, small blades are usually used in high temperature and high pressure section of the turbine. Therefore, where the margin of the material strength is not sufficient, an increase in the additional torsional stress or the local stress is harmful on the blade reliability.

Further, in the twist type blade shown in FIGS. 18(*a*) and 18(*b*), during rotor assembly, each blade must be assembled to the rotor by pushing the blade against the adjacent blade with a strong force under the conditions that the blade is maintained twisted. Therefore, a special jig or stopper must be prepared, and consequently another problem arises in that the assembly work takes a long time.

On the other hand, in the blade formed with a wedge type shroud shown in FIG. 19(*a*) and (*b*), no blade torsional deformation is used, so that this snubber structure can be applied to a relatively short blade of high rigidity. Further, the shrouds of the adjacent blades can be brought into pressure contact with each other during the turbine rotation. However, there is a possibility that the offset shifted blades 1*a* will return again to their original positions after the turbine has stopped. Even if they do not return to their original positions naturally, when a small shock is applied to the blades, the offset blades tend to be easily returned to their original positions. Therefore, when the blades are shifted or moved at start and stop of the turbine, the above-mentioned blade movement causes abrasion in the contact surfaces between the shrouds and tends to damage the blade dovetail portions. This is not desirable from the viewpoint of rotor balance.

There is another possibility that even when the centrifugal force is applied the blade 1*a* cannot be shifted sufficiently due to the obstruction by the adjacent shrouds 3*b* of the fixed blades 1*b*, so that the turbine is rotated under the conditions that the load bearing surface 7*a* of the blade dovetail portion 6*a* of the blade 3*a* and the load bearing surface 8*a* of the rotor 2 are not brought into contact with each other. In this case, since all the centrifugal force of the blade 1*a* is applied to only the adjacent blades 1*b*, another problem arises in that an excessive local stress could be generated in the shroud, blade and blade dovetail portions of the adjacent blades 1*b*.

Further, in the prior art blades of this type, there exists another problem that no means is provided for adjusting the position of the blades in the rotor axial direction during assembly. In more detail, as shown in FIG. 19(*b*), there are gaps S2, S3 and S4 between the blade 1*a* and the rotor 2 in the axial direction of the rotor 2 in the fitting portion between the two. These gaps are inevitably produced due to machining tolerances of the blade 1*a* and the rotor 2, and it is impossible to reduce these gaps to zero. If these gaps are large, the snubber blade 1*a* will be shifted inclinedly relative to the axial direction according to the contact conditions between the wedge shaped contact surfaces of the shrouds. When the blade is shifted inclinedly relative to the axial direction, an imbalanced load will be applied to the load bearing surfaces of the dovetail portions and an excessive stress will inevitably be generated in the blade dovetail portions.

SUMMARY OF THE INVENTION

With these problems in mind, therefore, it is an object of the present invention to provide a rotor blade damping structure by which the contact surfaces of shrouds of adjacent blades are always kept in pressure contact with each other with certain surface pressure, under all operating conditions such as when the rotor is accelerated, decelerated, and rotated at the rated rotational speed, so as to provide a sufficient dynamic stress reduction and damping properties without producing any excessive initial stress or any excessive operating stress in the blade or the blade dovetail portions; and further to provide a turbine to which a rotor thus constructed is applied.

To achieve the above-mentioned object, the present invention provides a rotor blade damping structure for an axial-flow turbine having blades arranged around a rotor in the turbine circumferential direction, the blades having shrouds formed integrally therewith at radially outer ends thereof, each of the shrouds having opposite front and rear contact surfaces with respect to a turbine rotational direction, the shrouds being arranged in such a way that shrouds of adjacent blades are brought into contact with each other at the contact surfaces during rotation, wherein: at least one of the front contact surface and the rear contact surface of each of the shrouds is formed so as to have certain angle with respect to a radial line connecting the rotor center and the contact surface; a cross-section taken in a plane perpendicular to the turbine rotational axis of the shroud of a first kind is formed into a trapezoidal shape converging radially outward; a cross-section taken in a plane perpendicular to the turbine rotational axis of the shroud of another blade of a second kind circumferentially adjacent is formed in an inverted trapezoidal shape converging radially inward; and half of an angle formed between the front contact surface and the rear contact surface of each of the shrouds is smaller than a static friction angle of the contact surfaces.

Further, the present invention provides a rotor blade damping structure for an axial flow turbine, having radial blades arranged around a rotor in a turbine circumferential direction, wherein: each of the blades is formed with a boss projecting from an intermediate portion on both sides thereof in a turbine circumferential direction, each of the bosses having opposite front and rear contact surfaces with respect to a turbine rotational direction, the blades being arranged in such a way that bosses of two adjacent blades are brought into contact with each other at said contact surfaces during rotation; the front contact surface and the rear contact surface of each of the bosses are formed so as to have certain angle with respect to a rotor radial line connecting the rotor center and each of the contact surfaces; a cross-section taken in a plane perpendicular to the turbine rotational axis of the boss of a blade is of a trapezoidal shape converging radially outward; a cross-section taken in a plane perpendicular to the turbine rotational axis of the boss of another blade circumferentially adjacent to the blade is of an inverted trapezoidal shape converging radially inward; and half of an angle formed between the front contact surface and the rear contact surface of each of the bosses is smaller than a static friction angle of the contact surfaces.

In the rotor blade damping structure according to the present invention, when the rotor is rotated, the trapezoidal shape shroud or boss of a blade is pressure fitted between two other shrouds or bosses of two adjacent blades owing to centrifugal force produced on the blade and on the basis of the wedge effect between the contact surfaces of the shrouds or bosses of the blades, so that the contact surfaces of the shrouds or bosses of the blades are brought into pressure contact with each other. In this case, half of the angle between the front contact surface and the rear contact surface of the shroud or the boss in the turbine rotational direction is made smaller than the static friction angle of the contact surfaces, so that once the trapezoidal shaped shroud or boss is pressure fitted between the two inverted trapezoidal shaped shrouds or bosses of the blades this pressure fitting condition is maintained so that the pressure-fitted trapezoidal shaped shroud or boss will not be caused to return to their original radially inward position. Accordingly, under all operating conditions, such as when the rotor is accelerated, decelerated or rotated at a rated rotational speed, the shrouds or bosses of all the blades are kept in pressure contact with each other at the contact surfaces thereof, thus providing a superior dynamic stress reduction and damping properties to the rotating blades under all turbine operating conditions.

BRIEF DESCRIPTION OF THE DRAWINGS

FIG. 12(*b*) is a top view showing the same blades when seen from radially above the turbine;

FIG. 18(*b*) is an illustration explanatory of a plurality of blades of the type shown in FIG. 18(*a*) when assembled to a rotor;

FIG. 19(*b*) is an illustration explanatory of a blade attachment portion of the blade shown in FIG. 19(*a*), as seen in the rotor circumferential direction;

FIG. 20(*b*) is an illustration for explaining low-order vibration of the grouped blades shown in FIG. 20(*a*).

DESCRIPTION OF THE PREFERRED EMBODIMENTS

A first basic embodiment of the present invention will be first described hereinbelow with reference to the attached drawings.

Figure 1:
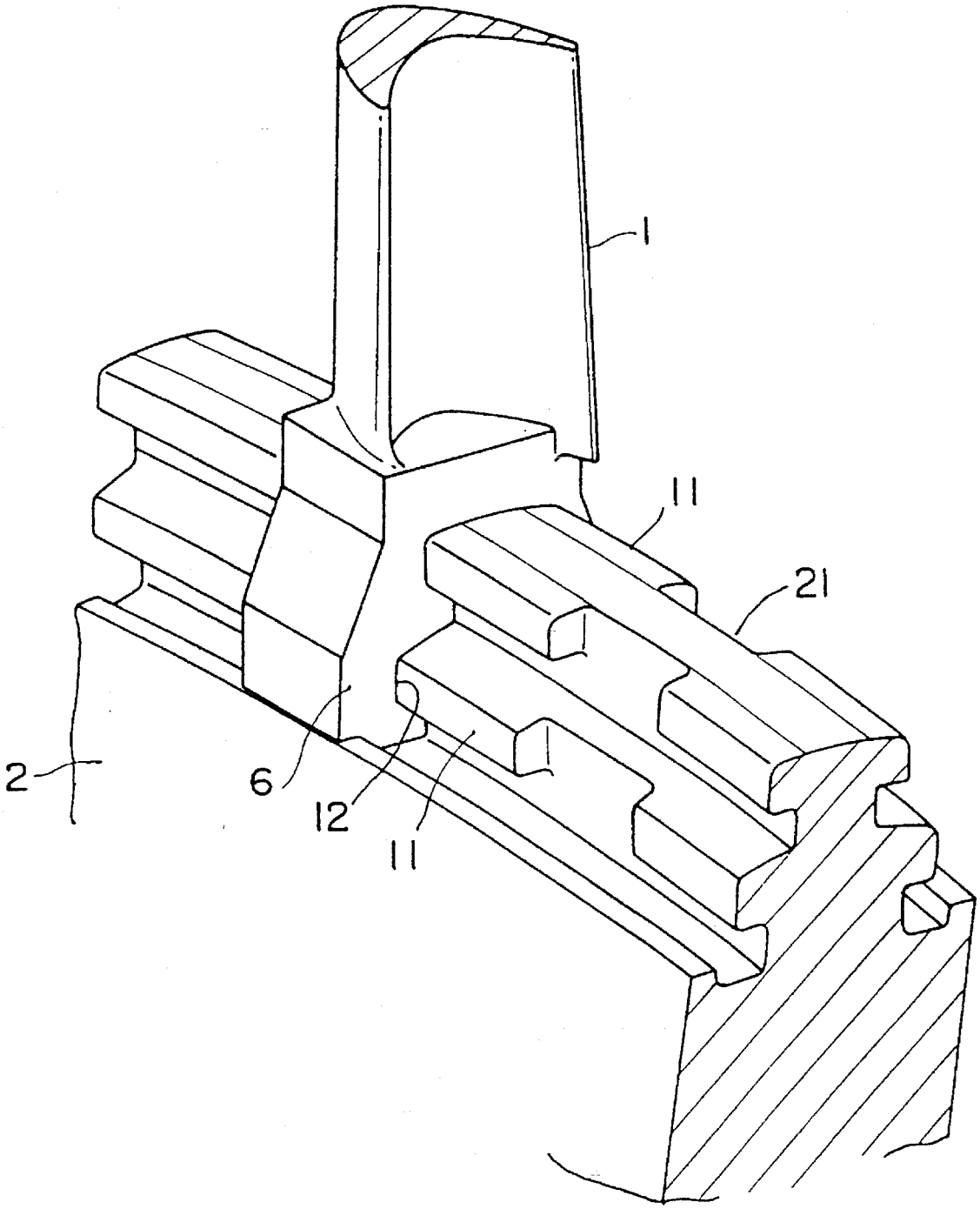
FIG. 1 is a perspective view showing a blade assembled to a rotor in a first embodiment of the rotor blade damping structure according to the present invention.

FIG. 1 shows a blade 1 attached to a turbine rotor 2. The rotor 2 is formed with a plurality of protrusions 11 extending on and along the circumferential portion of the turbine rotor 2. These protrusions 11 fit in grooves formed in a dovetail attachment portion 6 of the blade 1. In FIG. 1, the reference numeral 21 designates a cutout portion through which the final blade 1 is assembled to the rotor 2, as described in further detail hereinafter.

Figure 2:
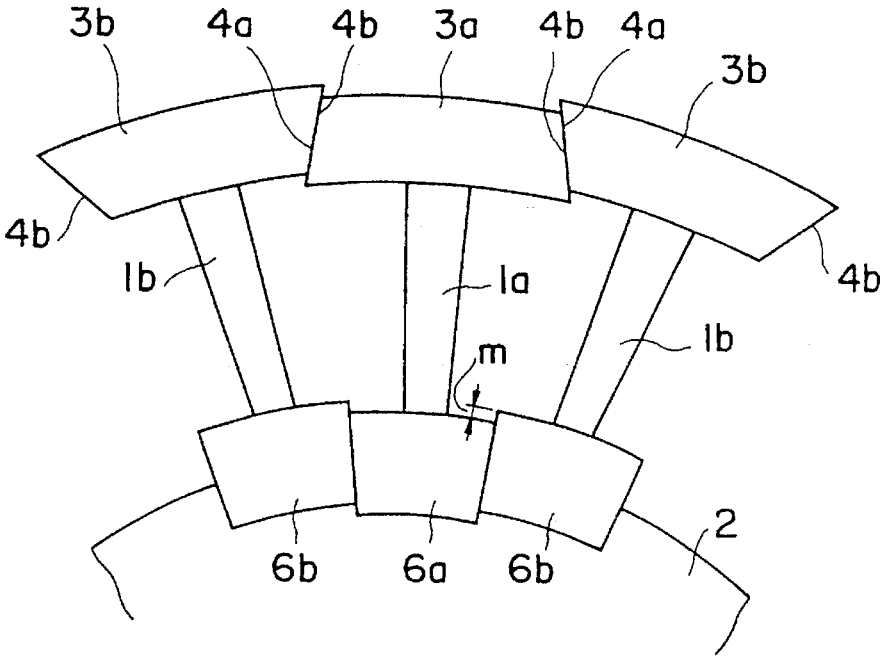
FIG. 2 is a partial front view showing a manner of assembling two types of blades of the first embodiment of the structure according to the present invention to an axial-flow turbine.
Figure 3A:
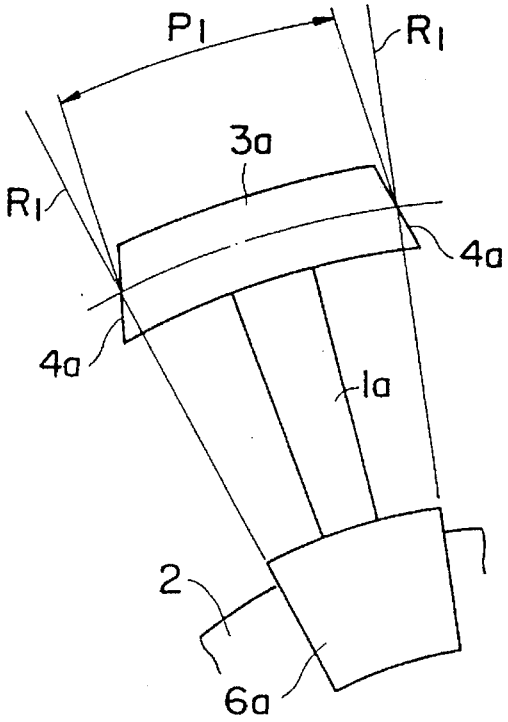
FIGS. 3(*a*) and (*b*) are diagrammatical views showing two types of blades of the structure shown in FIG. 2.
Figure 3B:
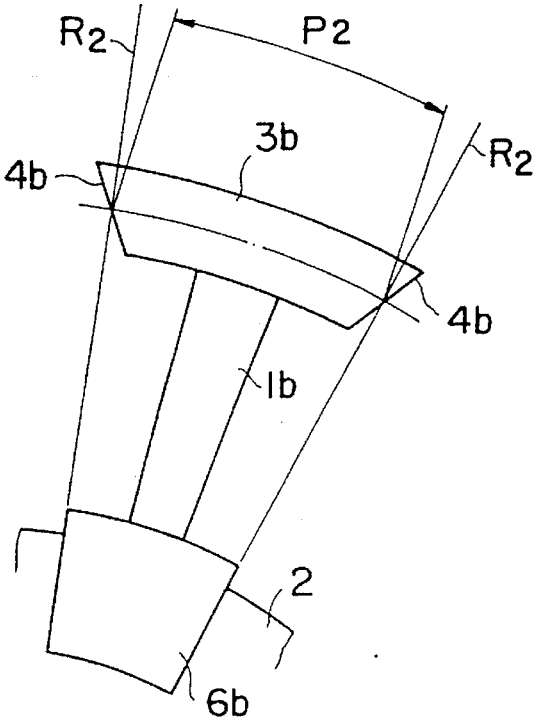

FIG. 2 is a view in the turbine axial direction and shows blades 1 assembled to the rotor 2. In FIG. 2, the blades are composed of two kinds of blades 1*a* and 1*b* different from each other in the shape of a shroud 3 formed integrally with the top of the blade 1. These blades 1*a* and 1*b* are formed with shrouds 3*a* and 3*b*, respectively, and are attached to the rotor 2 alternately, as shown. In more detail, as shown in FIG. 3(*a*), the shroud 3*a* formed integrally with the top of the blade 1*a* has two contact surfaces 4*a*. These two contact surfaces are brought into contact with contact surfaces 4*b* of the shrouds 3*b* of the two adjacent blades 1*b* on both sides thereof. At least one of contact surfaces 4*a* is inclined at certain angle with respect to a radial line R1 connecting the rotor center and the middle of the contact surface 4*a*, so as to form a trapezoidal shape in cross section of the shroud 3*a*, when seen along the rotor axial direction. That is, a line extending from the circumferentially front-side contact surface 4*a* and another line extending from the rotationally rear-side contact surface 4*a* intersect each other at the radially outer side of the shroud 3*a*. In other words, the cross-section taken in a plane perpendicular to the axial direction of the turbine of the shroud 3*a* converges radially outward.

On the other hand, as shown in FIG. 3(*b*), a shroud 3*b* formed integrally with the top of the blade 1*b* adjacent to the blade 1*a* has two contact surfaces 4*b*. These two contact surfaces are brought into contact with contact surfaces 4*a* of the shrouds 3*a* of the two adjacent blades 1*a* on both sides thereof. At least one of contact surfaces 4*b* is inclined at certain angle with respect to a radial line R2 connecting the rotor center and the middle of the contact surface 4*b*, so as to form an inverted trapezoidal shape in cross section of the shroud 3*b*, when seen from the rotor axial direction. That is, a line extending from the rotationally front-side contact surface 4*b* and another line extending from the rotationally rear-side contact surface 4*b* intersect each other at the radially inner side of the shroud 3*b*. In other words, the cross-section taken in a plane perpendicular to the axial direction of the turbine of the shroud 3*b* diverges radially outward.

Further, the sum of the pitch P1 of the trapezoidal shroud 3*a* of the blade 1*a* and the pitch P2 of the inverted trapezoidal shroud 3*b* of the blade 1*b* is made larger than the sum of two geometrical pitches calculated on the basis of the shroud diameter in the normally assembled state and the number of the blades as:

$$\pi\times(\text{shroud diameter is normally assembled state})\div(\text{number of all blades})\times 2$$

Figure 4A:
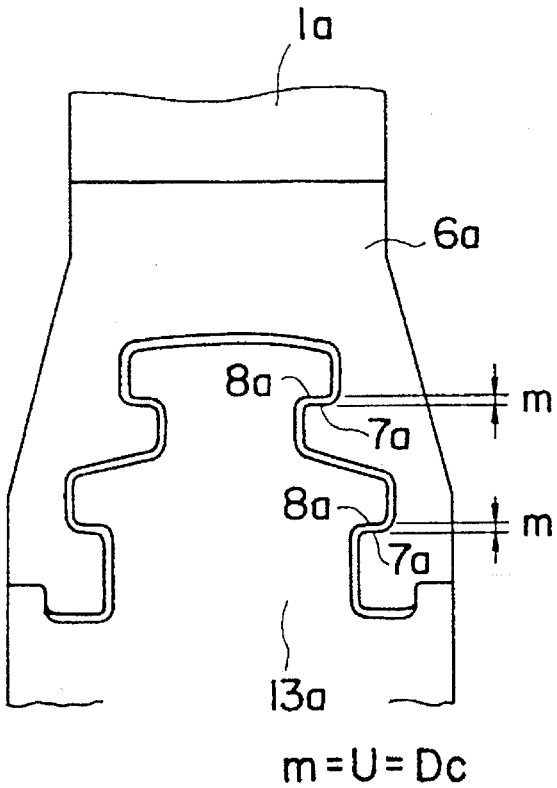
FIGS. 4(*a*) and (*b*) are illustrations explanatory of different assembled states of blade dovetail attachment portions of the two types of blades of the structure shown in FIG. 2, respectively.
Figure 4B:
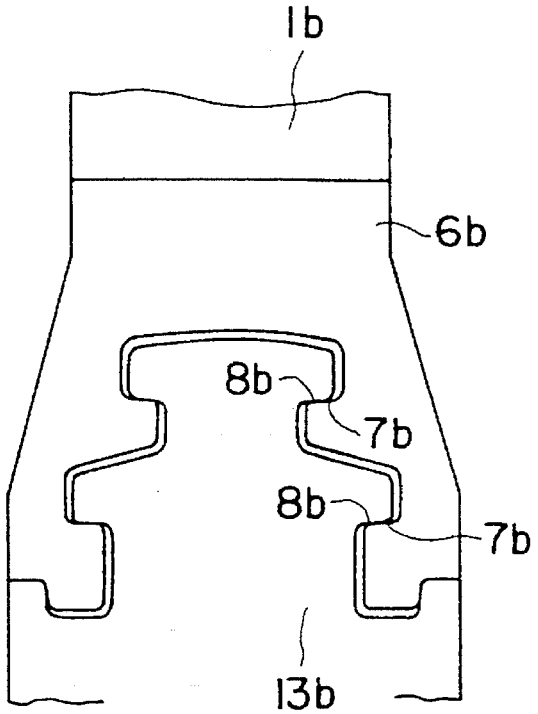

On the other hand, FIGS. 4(*a*) and (*b*) show an example of blade dovetail attachment portions 6*a* and 6*b* of two blades 1*a* and 1*b* in the blade assembly, respectively. As shown in FIG. 4(*a*), in the case of the blade 1*a*, a gap is formed between an attachment 6*a* of the blade 1*a* and an attachment portion 13*a* of the rotor 2 in such a way as to form a gap m between a load bearing surface 7*a* of the blade 1*a* and a load bearing surface 8*a* of the rotor 2. In other words, the blade 1*a* is in a state lowered in the radially inward direction by the amount of the gap m in comparison with the position in the normally assembled state.

Further, as shown in FIG. 4(*b*), in the case of the blade 1*b*, no gap is formed between the load bearing surface 7*b* of the blade 1*b* and the load bearing surface 8*a* of the rotor 2. In other words, the blade 1*b* is kept raised in the radially outward direction in the normally assembled state, in the same way as when the rotor is being rotated.

The blade 1*a* formed with the trapezoidal shroud 3*a* and the blade 1*b* formed with the inverted trapezoidal shroud 3*b* are assembled alternately to the rotor as shown in FIG. 2.

Figure 5:
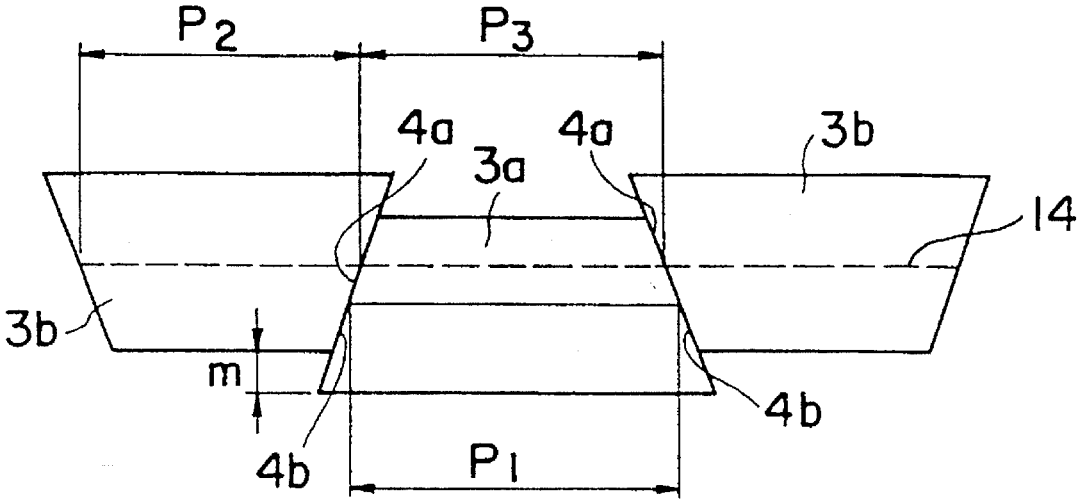
FIGS. 5(*a*) and (*b*) are illustrations explanatory of functions of shrouds of the blades of the structure shown in FIG. 2 in more simplified form.
Figure 5:
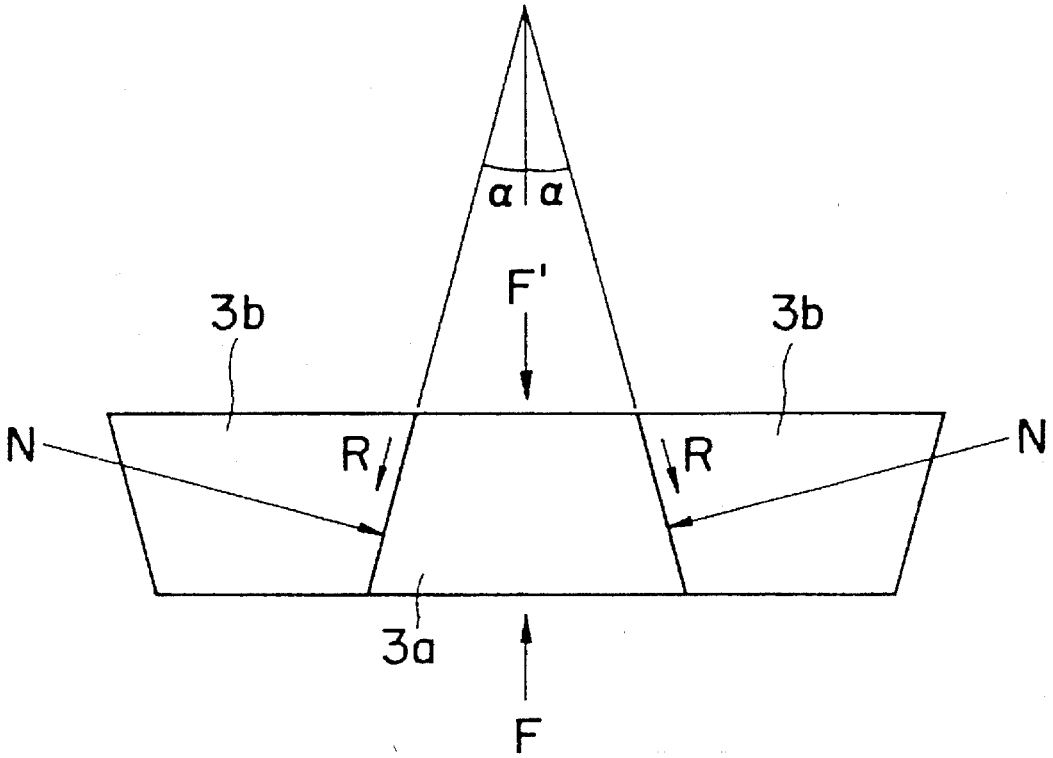

However, when the blades 1*a* and 1*b* are assembled simply as they are, the contact surfaces of the two shrouds will interfere with each other, so that it will be impossible to assemble all the blades along the circumferential surface of the rotor 2 (because the pitch P1 or P2 is larger than the geometrical pitch). Accordingly, as shown in FIG. 4(*a*), the blade 1*a* formed with the trapezoidal shroud 3*a* is attached to the rotor 2 in such a way as to be shifted slightly radially inward relative to the adjacent blades 1*b*. In other words, the respective blades 1*a* and 1*b* are assembled in such a way that the contact surfaces 4*a* and 4*b* of the respective shrouds 3*a* and 3*b* are brought into contact with each other. In this case, however, the blade 1*a* having the trapezoidal shroud 3*a* is assembled, as shown in FIG. 4(*a*), with the blade 1*a* lowered by a gap m radially inward as compared with the normal operating condition. Further, the blade 1*b* having the inverted trapezoidal shroud 3*b* is assembled, as shown in FIG. 5(*b*), with the blade 1*b* raised radially outward as in the case when the rotor 2 is being rotated. FIG. 2 shows the blades 1*a* and 1*b* assembled in this way, as seen along the axial direction of the rotor. In FIG. 2, it looks as if the wedge-shaped shroud 3*a* of the blade 1*a* is struck into the space between the two adjacent shrouds 3*b* of the blades 1*b*.

When the rotor is rotated in this assembled condition, the blade 1*a* is caused to shift radially outward due to the centrifugal force of the blade 1*a*, so that the load bearing surfaces 7*a* of the blades 1*a* are engaged with the load bearing surfaces 8*a* of the rotor 2 and further the shroud slides into the two shrouds 3*b* with a wedge effect, so that surface pressure can be produced between the two contact surfaces 4*a* and 4*b* of the shrouds 1*a* and 1*b* with the result that the regular assembled condition is attained.

The above-mentioned positional relationship between the two shrouds will be explained below more plainly by simplifying the shroud shape- The shroud structure shown in FIG. 2 can be simplified by replacing the arcuate cross-sectional shape with a simple straight-line planar trapezoidal shape shown in FIG. 5(*a*). FIG. 5(*a*) shows a state where the blades are assembled, in which the trapezoidal shroud 3*a* is assembled between the two inverted trapezoidal shrouds 3*b* under such a condition that the contact surfaces 4*a* and 4*b* of the shrouds 3*a* and 3*b* are in contact with each other and the trapezoidal shroud 3*a* is lowered radially inward by a gap m relative to the inverted trapezoidal shrouds 3*b*.

Accordingly, the pitch P1 of the trapezoidal shroud 3*a* is reduced to P3 along the pitch line 14 in the normally assembled state shown in FIG. 5(*a*). It is thus possible to match the sum of the pitches (P2+P3) of the two adjacent shrouds 3*b* and 3*a* with the geometrical pitch (calculated on the basis of the shroud diameter and the number of blades).

FIG. 5(*b*) shows a state in which the shroud 3*a* is shifted to the normally assembled position due to the centrifugal force during rotation. The equilibrium of forces applied to the shrouds will be explained below with reference to FIG. 5(*b*). Here, when a force for pushing the shroud 3*a* radially outward is denoted F; normal force applied to the shroud contact surface is denoted by N; a static friction force is denoted by R; and half of the apex angle made by the two side contact surfaces 4*a* of the be obtained based on equilibrium of static force:

$$F=2(N\sin\alpha+R\cos\alpha) \quad (1)$$

Here, if the static friction coefficient of the contact surface is denoted by μ and the static friction angle is denoted by λ, the static friction force R can be expressed as:

$$R=\lambda N=N\tan\lambda \quad (2)$$

When the above expression (2) is substituted into the expression (1), the following relationship can be obtained:

$$F=2N[\sin(\lambda+\alpha)/\cos\lambda] \quad (3)$$

The above equation (3) indicates that when the angle α is small, it is possible to obtain a large normal force N by a small force F. That is, since the force F is produced by the centrifugal force of the blade, the equation (3) indicates that a large contact surface force can be secured by a small centrifugal force. Further, once the rotor begins to rotate, the shroud 3*a* of the blade 1*a* will be raised radially outward to the normally assembled position certainly.

The force applied to the adjacent inverted trapezoidal shrouds 3*b* will now be considered. The normal force N produced at the contact surface is applied mostly to the shroud 3*a* as a compression force. The friction forces R are applied to the blade as tension through the shroud. However the friction forces are far smaller than the centrifugal force on the blade. Therefore, this friction force is substantially negligible. Even if not neglected, the friction force is applied to both of the surfaces of the shroud symmetrically, this force can be handled easily.

Here, the relationship between the shifting distance of the blade and the compression force applied to the shroud will be considered below. Here, the pitch reduction of the trapezoidal shroud 3*a* is denoted by ΔP=P1−P3 and the gap m at the attachment load bearing surface of the shiftable blade 1*a* shown in FIG. 4(*a*) is denoted by Dc. In order that the shiftable blade 1*a* is perfectly shifted and thereby the load bearing surfaces 7*a* of the blade 1*a* are brought into contact with the rotor load bearing surfaces 8*a* of the rotor 2, it is necessary that the shifting distance U matches the gap, i.e. U=Dc. Under these conditions, the following relationship can be established between the pitch reduction of the shroud and the shifting distance:

$$\Delta P=U\tan\alpha \quad (4)$$

Here, ΔP is proportional to the compression force on the shroud, and the relationship between ΔP and the normal force N at the contact surfaces can be expressed as:

$$N=Ec\cdot\Delta P \quad (5)$$

where Ec denotes a constant determined on the basis of the cross section area of the shroud taken along the rotor axial direction, the shroud pitch, the Young's modulus, etc. Therefore, it is understood that the contact surface pressure between the shrouds can be determined on the basis of the dovetail attachment gap Dc and the contact surface angle α and in accordance with the above-mentioned equations.

On the other hand, the condition in which the blade 1*a* is raised radially outward to the normally assembled position before the rotor rotation speed reaches the rated speed is that the pushing force F is smaller than the blade centrifugal force Fr at the rated rotational speed. However, when the angle α is increased, F becomes larger than Fr at a certain angle α or more. Therefore, it is not desirable to have an extremely large angle α. The fact that F is larger than Fr implies that the blade 1*a* will not be shifted radially outward even if the rotor rotational speed reaches the rated speed, so that the centrifugal force on the blade 1*a* is all received by the adjacent blades 1*b*. In other words, since an excessive centrifugal force is applied to the adjacent blades 1*b* through the shrouds 3*b*, a large stress twice as much as that under normal conditions is produced in the attachment portion of the blades 1*b*. As will be clearly understood from the above, it is necessary to set the angle α so that the pushing force F is smaller than the blade centrifugal force Fr at the rated rotor rotation speed.

Next, selection of the angle between the shroud contact surfaces and the rotor radial line will be described in further detail below. Conditions whereby the shroud 3*a* once raised radially outward to the normally assembled position shown in FIG. 5(*b*) is returned to the original position shown in FIG. 5(*a*) will be considered. When a force F' for lowering the shroud 3*a* radially inward is applied to the upper surface of the shroud, friction forces R are produced in the reverse direction to that shown in FIG. 5(*b*), and hence a force equilibrium is obtained as follows:

$$F' = 2(R\cos\alpha - N\sin\alpha) = 2N[\sin(\lambda - \alpha)/\cos\lambda] \quad (6)$$

This equation (6) indicates that if $\lambda<\alpha$; that is, if the half angle α formed by the shroud contact surface is larger than the friction angle λ, F' is negative, so that the shroud 3*a* will drop inward naturally. In other words, under these conditions, whenever the turbine is started and stopped, the trapezoidal shroud 3*a* will be raised radially outward and then lowered inward repeatedly. This is not desirable from the viewpoints of abrasion of the contact surfaces and the balance of the rotor.

What is desirable from the viewpoints of blade reliability and the rotor stability is that once the blade 3*a* is assembled in the normally assembled position the obtained position of the blade 3*a* can be maintained as it is. This desirable condition requires that $\lambda>\alpha$ that is, the half angle α formed by the shroud contact surface is set smaller than the static friction angle λ, as will be understood from the above equation (6). Under this condition, the trapezoidal shroud 3*a* once shifted in the normal condition will not lower, even if the rotor stops and therefore no centrifugal force is applied, unless an external force F' shown in FIG. 5(*b*) is applied to the shroud 3*a*.

That is, during the manufacturing process of the turbine rotor in a factory, for instance, once the rotor speed is increased for performing the high speed rotor balancing test which has usually been carried out, all blades are assembled and fixed in the normally assembled position and kept stably as they are.

FIG. 5(*a*) shows a case where the shroud contact surfaces are brought in contact with one another in advance at the beginning of the assembly work. However, even if there is a small gap between the shroud contact surfaces at the beginning of the assembly work the above-mentioned assembly relationship based on the concept of the present invention can be established, as long as the half apex angle α of the trapezoidal shroud or the gap m is selected appropriately. In this case, however, it is necessary that the blade shifting distance U' is divided into two components, that is, a shifting distance U1 before the shrouds are brought into contact with one another and the shifting distance U2 after the shrouds are brought into contact with one another:

$$U' = U1 + U2 \quad (7)$$

and U of the equation (4) is replaced with U2 of the equation (7).

Figure 6:
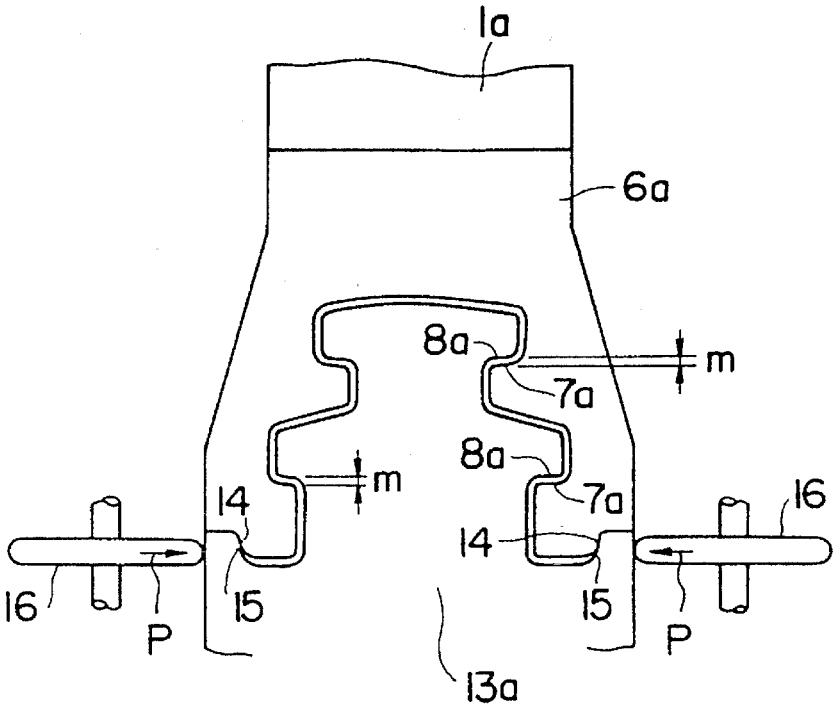
FIG. 6 is an illustration explanatory of the assembled state of a first modification of the blades of the first embodiment of the structure according to the present invention.

FIG. 6 shows a first modification of the first embodiment according to the present invention, which is related to the blade assembly method. In FIG. 6, the blade 1*a* is assembled in a state offset radially inward, in such a way that a gap can be formed between the load bearing surface 7*a* of the blade 1*a* and the load bearing surface 8*a* of the rotor dovetail attachment 13*a*. When the rotor is being rotated and thereby, the blade 1*a* is shifted radially outward, this gap m is reduced to zero so that the two load bearing surfaces 7*a* and 8*a* are brought into contact with each other. The rotor dovetail attachment 13*a* is formed with two grooves 15 with which the dovetail attachment 6*a* of the blade 1*a* are engaged. In this modification, after the blade 1*a* has been assembled to the rotor 2, both the side surfaces of the rotor dovetail attachment 13*a* are deformed plastically by means of two rollers 16 arranged on both sides of the rotor 2. When the outer side surfaces of the grooves 15 are securely brought into contact with bottoms 14 of the dovetail attachment 6*a* of the blade 1*a*, respectively, it is possible to restrict the shifting direction of the blade 1*a* due to centrifugal force generated on the blade 1*a* when rotated. This restriction is effective in assembling the blade 1*a* correctly perpendicular to the axial direction of the rotor, that is, it allows the blade 1*a* to shift correctly at right angles to the turbine axis without inclining and thereby to make uniform the loads applied to the load bearing surfaces of both the protrusions 11 of the rotor 2 (see FIG. 1).

The above-mentioned fastening of the blade to the rotor by use of the rollers 16 can be referred to as roller pressing, which can be done easily by pushing the rollers 16 against the rotor 2 during very low speed rotation. Further, it is apparent that the roller pressing is effective when carried out before the rotor is rotated at high speed.

Figure 7:
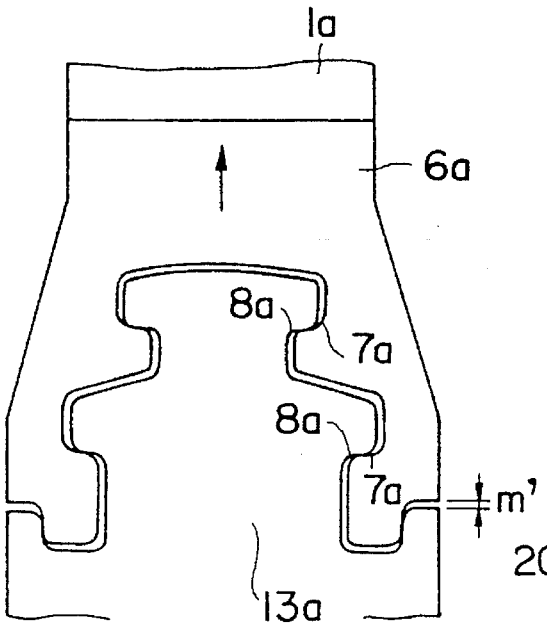
FIGS. 7(*a*) and (*b*) are illustrations explanatory of assembled states of a second modification of the blades of the first embodiment.
Figure 7:
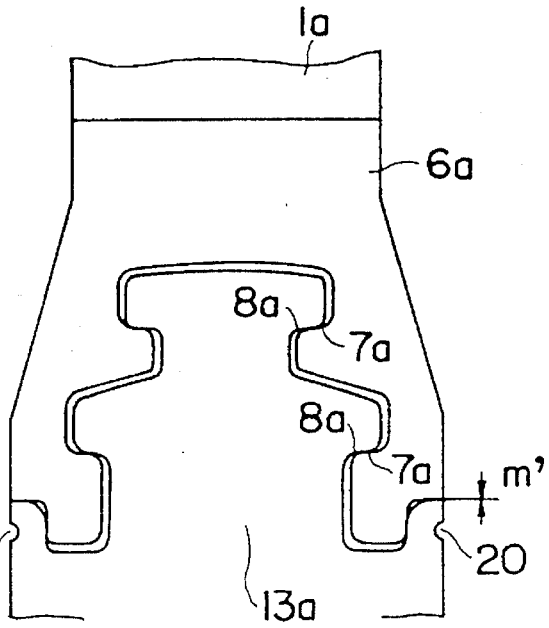

FIGS. 7(*a*) and 7(*b*) show a second modification of the first embodiment. In FIG.7(*a*), the blade 1*a* assembled as described above is shown as shifted by centrifugal force. Since the blade 1*a* is shifted radially outward, the load bearing surface 7*a* of the blade dovetail attachment 6*a* and the load bearing surface 8*a* of the rotor dovetail attachment 13*a* are in contact with each other. Therefore, the gap m (shown in FIG. 6) is zero, and instead another gap m' is produced between the bottom of the blade dovetail attachment 6*a* and the rotor dovetail attachment 13*a*. One of the features of the present invention is that the angle α between the forward side contact surface of the shroud and the rearward side contact surface thereof is smaller than the static friction angle λ. Accordingly, even if the turbine stops, the blade 1*a* is not returned to the original position, so that it is possible to maintain the position as shown in FIG. 7(*a*).

In a modification shown in FIG. 7(*b*), auxiliary means is additionally provided to fix the shifted blade 1*a* to the rotor. In FIG. 7(*b*), the reference numeral 20 denotes plastically formed impressions formed on both side surfaces of the rotor as a result of the roller pressing. When the gap m' is made substantially zero by means of this roller pressing, the blade 1*a* once shifted cannot be returned to the original position, so that it is possible to securely maintain the shifted condition as it is.

This roller pressing method is basically the same as that described with reference to FIG. 6. However, the effect of the pressing deformation (of the first modification) shown in FIG. 6 can be distinguished from that (of the second modification) shown in FIG. 7(*b*) by controlling the pressing force P shown in FIG. 6(*b*). In more detail, in the first modification, the rotor is plastically deformed before the rotor is rotated at high speed in such a way that the bottom portions 14 of the blade and the grooves 15 of the rotor are pressed together by a relatively small force P as in FIG. 6. However, in the second modification, the rotor is pressed together after the rotor is being rotated at high speed in such a way that the shifted blade is pressed by a relatively large force P as shown in FIG. 7(*b*) to plastically deform the opposite side surfaces of the rotor. The pressing force P can be adjusted easily by observing the deformed surfaces during the pressing process. With reference to FIG. 1 again, in the case of the turbine in which a plurality of blades 1 are assembled to the rotor 2 along the rotor circumference, the rotor dovetail attachment 6 is formed with at least one cutout 21. The blades can be assembled to the rotor by first inserting the blade through the cutout 21 in a radial direction and then engaging the inserted blade with the protrusions 11 of the rotor 2 and further sliding the engaged blade in the circumferential direction of the rotor in sequence. Therefore, the finally assembled blade of a stage is inevitably located at this cutout 21, so that the final blade will easily detach from the rotor.

Figure 8:
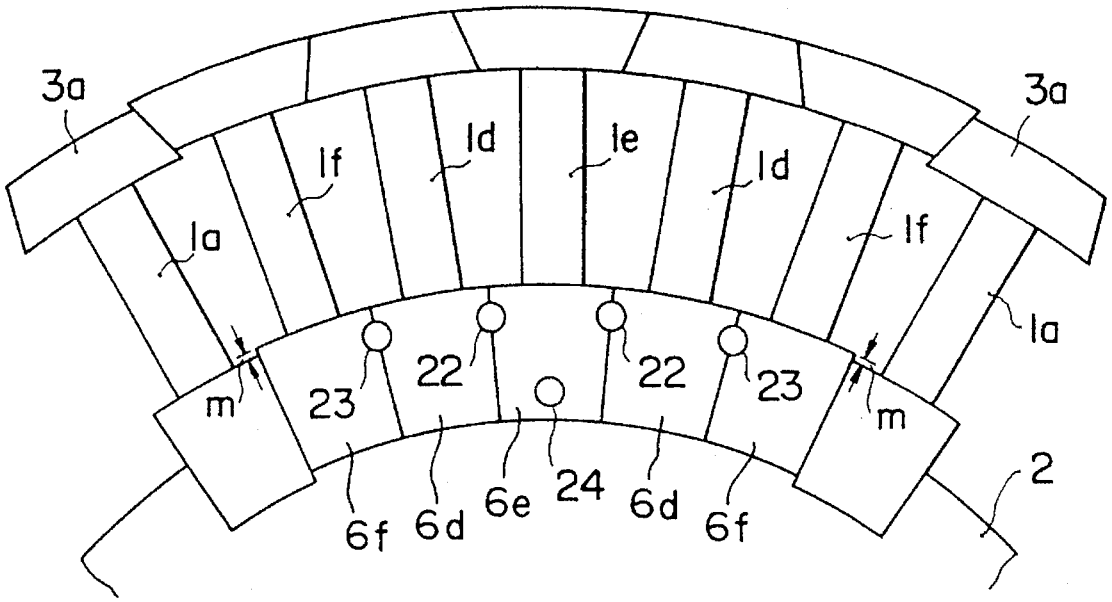
FIG. 8 is an illustration explanatory of a manner of fixing a blade of a third modification of the blades of the first embodiment.

FIG. 8 shows a third modification of the rotor blade damping structure according to the present invention, which is provided with a final blade assembling means for overcoming this problem. In FIG. 8, the finally fitted blade 1*e* and other blades 1*d* and 1*f* arranged in the vicinity of the final blade 1*e* are assembled along the circumference of the rotor 2. Keys 22 are inserted between the dovetail attachments 6*e* of the blade 1*e* and the dovetail attachments 6*d* of the two adjacent blades 1*d*, to share centrifugal force applied to the final blade 1*e* with the two adjacent blades 1*d* and further to prevent the final blade 1*e* from being removed during rotation. Therefore, half of the centrifugal force produced on the final blade 1*e* is applied to the dovetail attachment 6*d* of each blade 1*d*, and the centrifugal force of the blade 1*d* itself is also applied to each dovetail attachment 6*d*. To share these centrifugal forces with the next blade 1*f*, another key 23 is inserted between the contact surfaces of the dovetail attachments 6*d* and 6*f* of the two blades 1*d* and 1*f*. Under normal conditions, the insertion of these keys 22 and 23 is considered sufficient as the means of fixing the final blade 1*e* to the rotor. In the present invention, however, an additional stop pin 24 is passed into the final blade 1*e* to further securely prevent the final blade 1*e* from being removed by the centrifugal force thereof. When the stop pin 24 is not present, the final blade 1*e* is fixed only to the adjacent blades 1*d* on both sides, so that there is a possibility that a larger vibration stress is generated in the adjacent blades 1*d* in addition to the stress due to the centrifugal force. In this embodiment, however, since the stop pin 24 directly fixes the final blade 1*e* to the rotor 2, it is possible to effectively reduce stresses due to the centrifugal force and vibration stresses produced in the adjacent blades.

With reference to FIG. 8, another feature of the present invention will be described below. As already described, the final blade 1*e*, the adjacent blades 1*d* and further adjacent blades if are all fixed with the stop keys 22 and 23, respectively, so that these five blades are substantially restricted in radial movement relative to one another. Therefore, although the shrouds of the blades 1*d* are formed into a wedge-shape converging outward of the rotor, harmful results may occur such that these blades 1*d* cannot shift during rotation if these blades 1*d* are assembled in a state offset radially inward. To overcome this problem, the blades 1*e*, 1*d*, and if fixed to the rotor by means of the stop keys 23 are also fixed to the rotor by bringing the load bearing surfaces of the blades into contact with the load bearing surfaces of the rotor in assembly. That is, these blades are fixed to the rotor as shown in FIG. 7(*b*), without the possibility of being shifted radially outward due to rotation.

Figure 9:
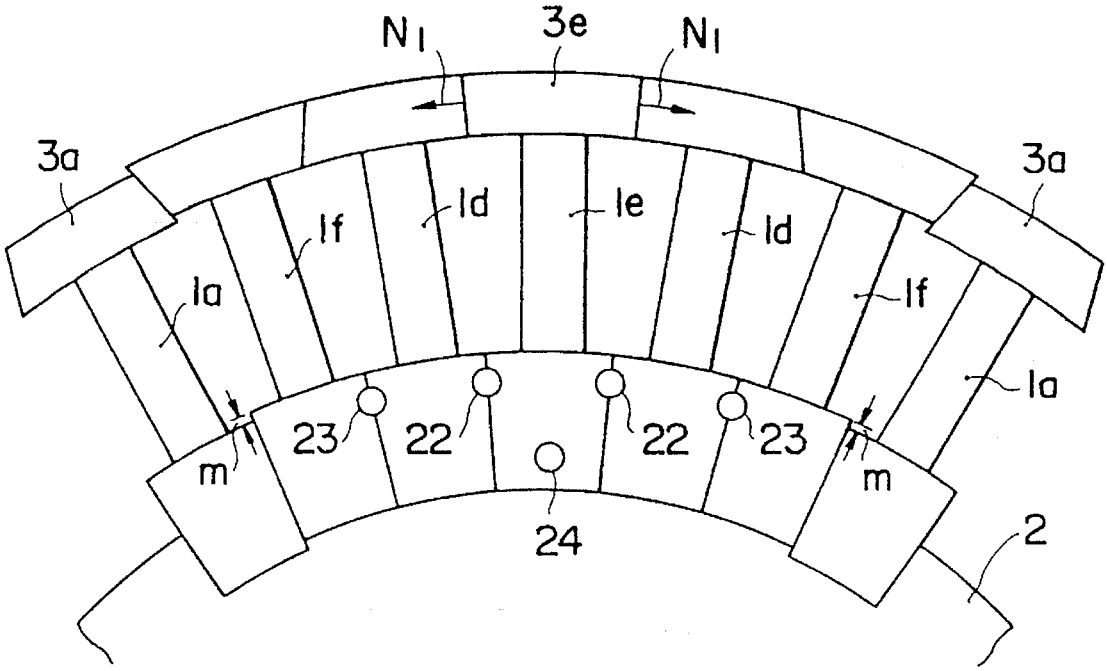
FIG. 9 is a view showing a fourth modification of the blades of the first embodiment.

FIG. 9 shows a fourth modification of the rotor blade damping structure according to the present invention, which is related to the shroud shape of the final blade 1*e*. In this modification, the opposite contact surfaces of the shroud 3*e* of the final blade 1*e* and the adjacent blades 1*d* coincide with radial lines of the rotor, without providing a substantially wedge-shaped shroud. Once the rotor 2 is rotated at high speed, blades 1*a* assembled on the circumferential surface of the rotor 2 are shifted (except the blades 1*d*, 1*e* to 1*f*), so that contact surface pressure is produced at the respective shroud contact surfaces throughout the circumference of the rotor. However, the contact surfaces of the shroud 3*e* of the final blade 1*e* extend radially, whereby no radially outward force components are included in the reactive forces applied to the contract surfaces of the final blade 1*e*. Therefore, the force which acts to shift the final blade 1*e* is only the centrifugal force, whereby it is possible to reduce deformation of the stop keys 22 and the stop pin 24, as well as the key holes and pin holes.

Figure 10:
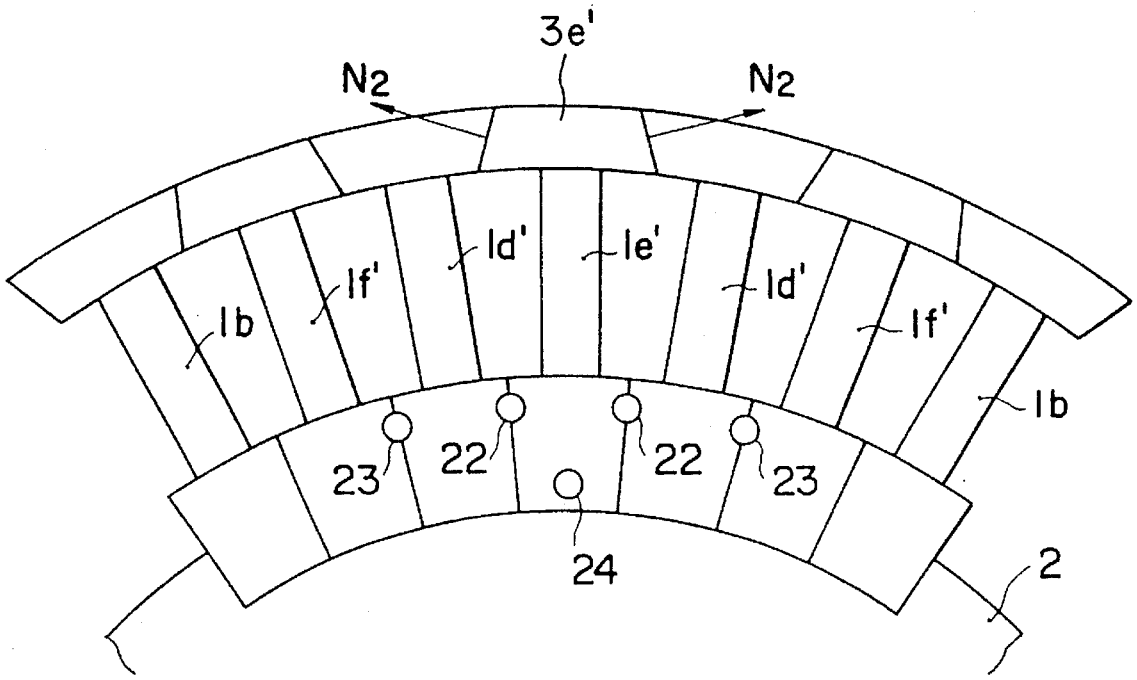
FIG. 10 is a view showing a fifth modification of the blades of the first embodiment.

FIG. 10 shows a fifth modification, which is related to the shroud shape of the final blade 1*e*'. In this modification, the blade arrangement is opposite to that shown in FIG. 8. That is, the shroud 3*e*' of the final blade 1*e*' is formed into such a wedge shape as to converge radially outward. In the same way as the case shown in FIG. 8, when the surface pressure is applied to the shroud contact surfaces throughout the circumference of the rotor 2, reaction forces N2 acting on the final blade 1*e*' have a radially outward component, so that the final blade 1*e*' is pushed radially inward. Accordingly, it is possible to reduce the force applied to the keys 22 and the pin 24 for fixing the final blade 1*e*' to the rotor. In other words, it is possible to reduce deformation of the stop keys 22 and 23, stop pin 24, key grooves, and pin hole more securely.

Figure 11:
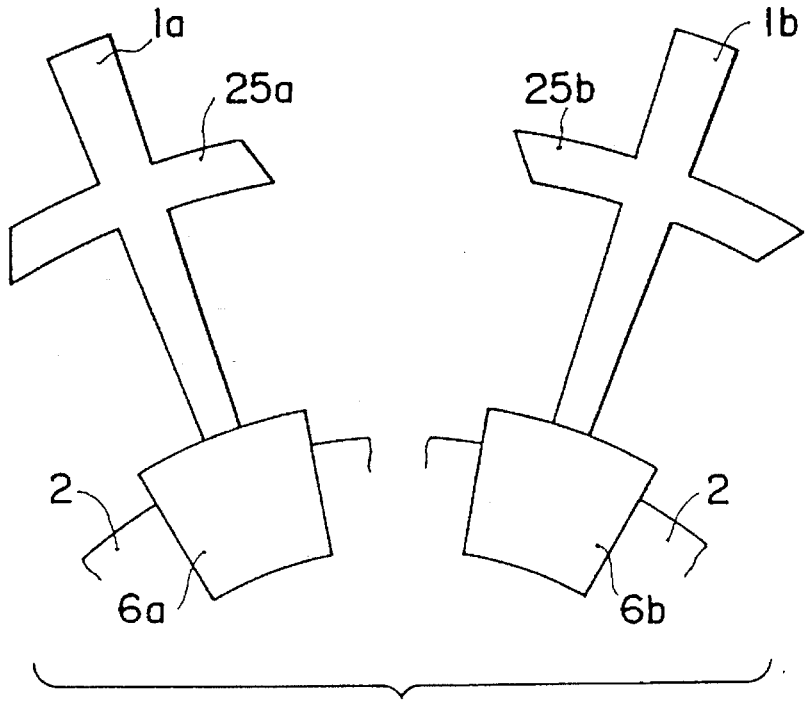
FIG. 11 is an illustration showing a second embodiment of the blades of the rotor blade damping structure according to the present invention.

FIG. 11 shows a second embodiment of the present invention. In this embodiment, a blades 1*a* and 1*b* are formed with two bosses 25*a* and 25*b*, respectively, protruding from an intermediate portion of the blades to both sides instead of being provided with shrouds formed at the blade tops. These two bosses 25*a* and 25*b* can function in the same way as the aforementioned shrouds. Therefore, it is apparent that the dynamic stress reduction and damping properties can be obtained as in the case of the shroud structure already explained.

Figure 12:
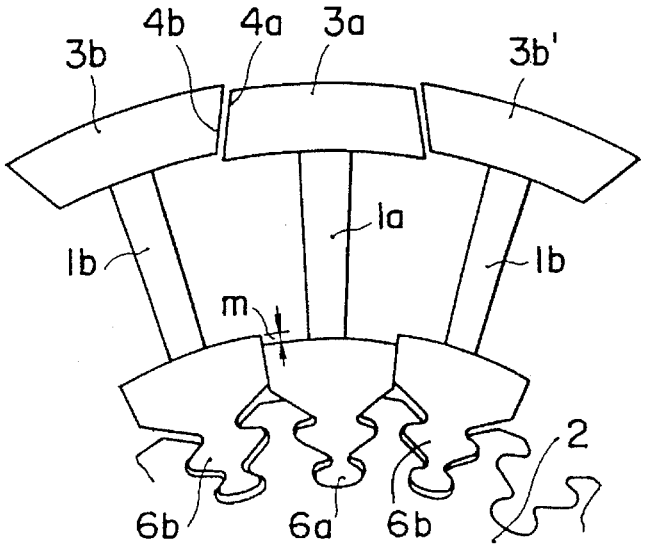
FIGS. 12(*a*) and (*b*) are illustrations showing a third embodiment of the blades of the rotor blade damping structure according to the present invention, in which FIG. 12(*a*) is a front view showing the blades when seen from the axially front side of the turbine.
Figure 12:
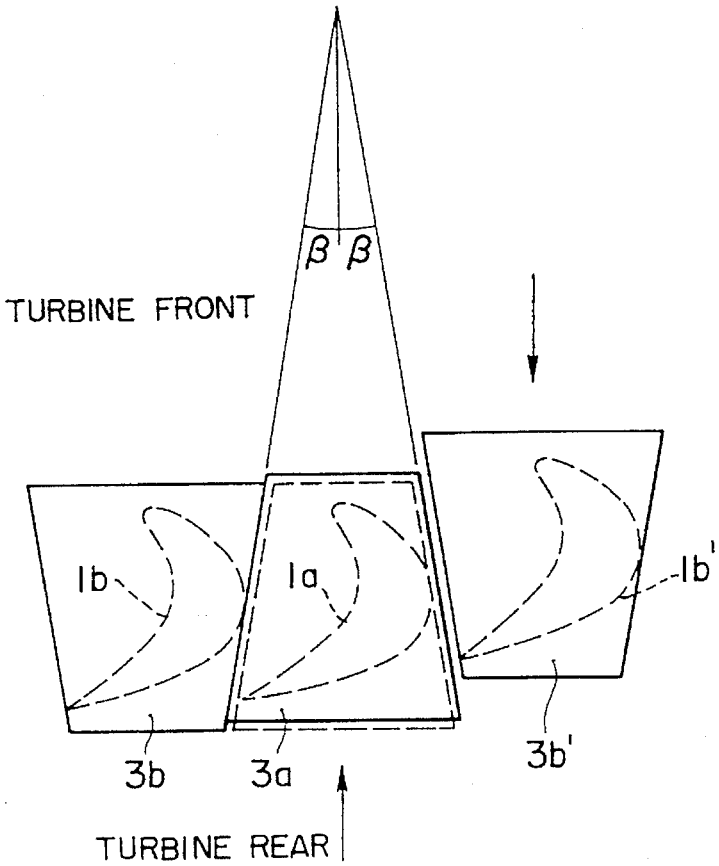

FIGS. 12(*a*) and (*b*) show a third embodiment of the present invention. In FIG. 12(*a*) in which the blades are seen from the axial direction of the rotor, the blades 1*a* and 1*b* are formed with dovetail attachments 6*a* and 6*b* so as to be inserted into the rotor 2 in the axial direction thereof. The blades are also assembled in such a way that the blade 1*a* having a trapezoidal shroud 3*a* is shifted radially inward by a gap m relative to the blades 1*b* having an inverted trapezoidal shroud 3*b*. In the case of a blade formed with an axial-entry type dovetail attachment, the circumferential position of the blade is determined by the Rotor-Axial position of the dovetail attachment of the blade, and as a result the two facing shroud contact surfaces 4*a* and 4*b* may have a gap therebetween (as shown in FIG. 12(*a*)) or may be brought into interfering contact with each other within the manufacturing tolerance of the blades. In other words, in this axial-entry type blades, it is impossible to adopt the circumferential-entry assembly method as described with reference to FIG. 1, in which the dovetail attachments of the blades are inserted radially through the cutout 21 and then slided along the circumference of the rotor in sequence until the shroud contact surfaces are brought into contact with each other.

FIG. 12(*b*) shows means for solving this problem, in which the blades are seen from the shrouds side. When the blades are seen from the top ends thereof, the two contact surfaces of the shrouds 3*a*, 3*b* and 3*b*' are so formed as to have mutual inclined angles with respect to each other. In more detail, the shroud 3*a* of the blade 1*a* is formed into a wedge shape converging in the axially frontward direction of the turbine, and the shrouds 3b and 3b' of two adjacent blades 1b and 1b' are formed into a wedge shape converging in the axially rearward direction of the turbine.

Therefore, when the shroud 3a is located in the position shown by the broken lines in which gaps exist between the shroud 3a and the adjacent shroud 3b (shown by the solid lines), the shroud 3a is pushed in the turbine frontward direction (shown by an arrow) to the position shown by the solid line in FIG. 12(*b*). As a result, it is possible to smoothly bring the contact surfaces of the shrouds 3a and 3b into contact with each other. Further, the adjacent shroud 3b' can be brought into contact with the shroud 3a by pushing the shroud 3b' in the rearward direction of the turbine.

As described above, when the blades are finely moved frontward and rearward alternately in sequence, it is possible to assemble all blades having the axial-entry type dovetail, respectively, smoothly in such a way that the shrouds can be brought into contact with one another.

In FIG. 12(*b*), the shroud wedge shapes as seen from a point radially inward of them are shown. In this case, the shrouds are engaged with each other with surface pressure. Therefore, it is not desirable that a force act to remove a shroud in the axial direction of the turbine due to the wedge effect. It will be apparent that the condition wherein such blade removal is prevented is to make the half apex angle $\beta$ of the wedge shape (as shown in FIG. 12(*b*)) of the shroud 3a to be smaller than the friction angle $\lambda(\beta<\lambda)$, in the same way as described with reference to FIG. 5(*b*).

Figure 13:
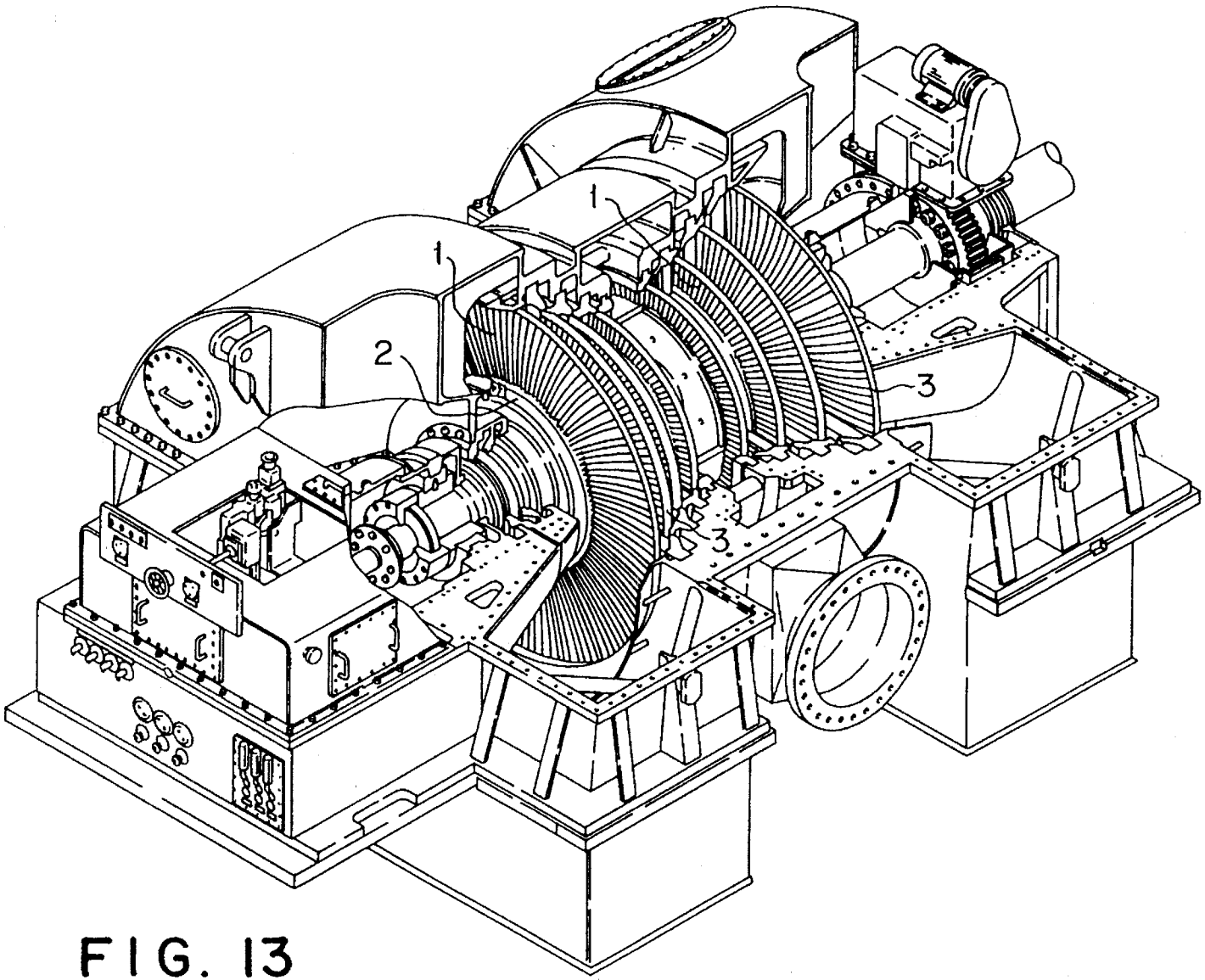
FIG. 13 is a perspective view showing an example of the axial-flow turbine to which the structure according to the present invention is applied.

FIG. 13 shows a geothermal turbine to which turbine blades and a dovetail attachment structure according to the present invention are applied, by way of example. In an integrally machined shroud structure according to the present invention, various problems such as stress concentration and corrosive substance accumulation (occurred in the assembled shrouds or holes with tie wires) can be prevented, whereby it is possible to reduce the vibration stress level. Therefore, when the present invention is applied to a geothermal turbine, in particular, it is possible to improve the turbine reliability remarkably. In addition, when the blades are made of a titanium alloy, it is possible to further improve the reliability due to the corrosion resistance of the titanium alloy.

Figure 14:
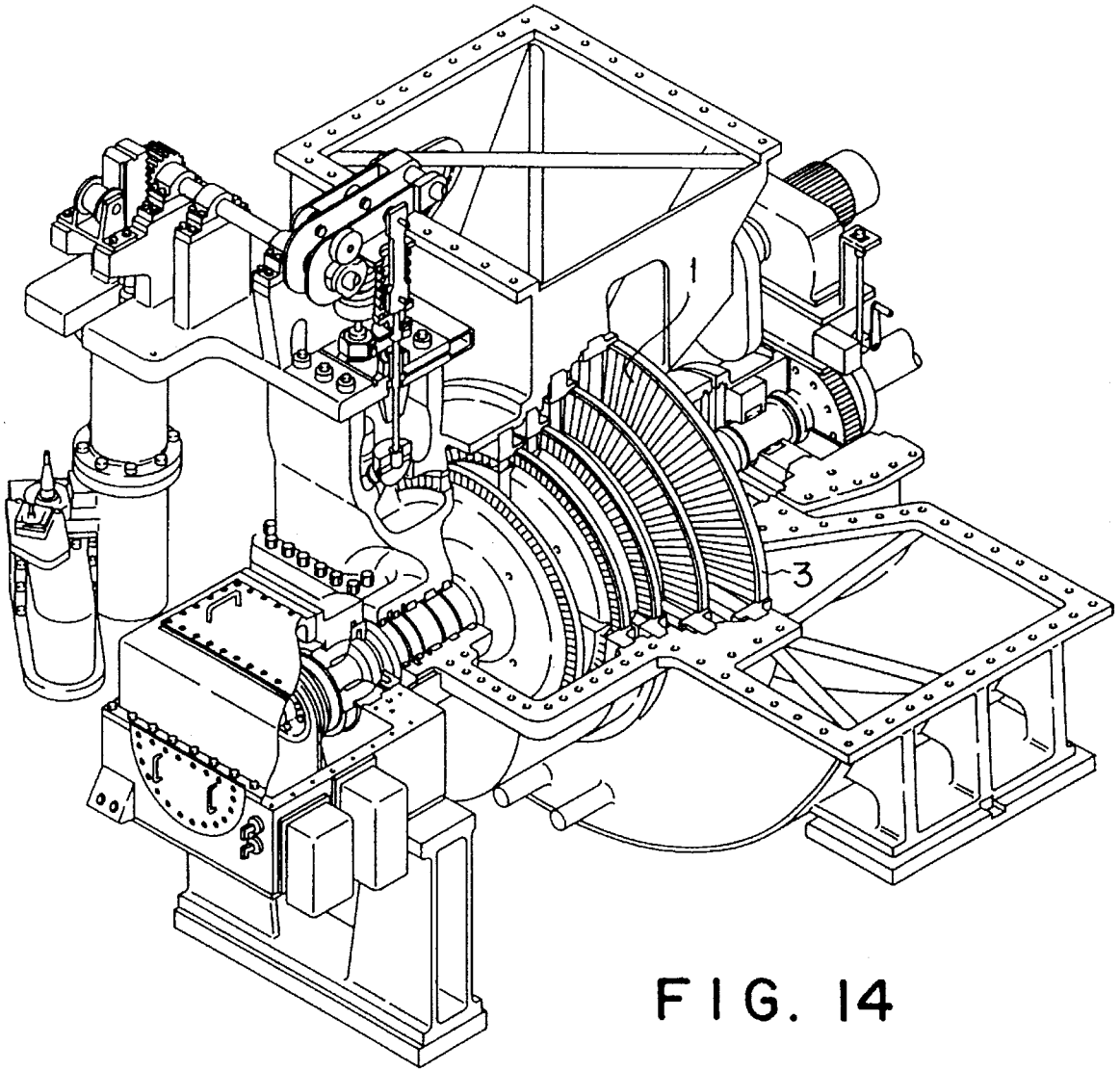
FIG. 14 is a perspective view showing another example of the axial-flow turbine to which the structure according to the present invention is applied.
Figure 15:
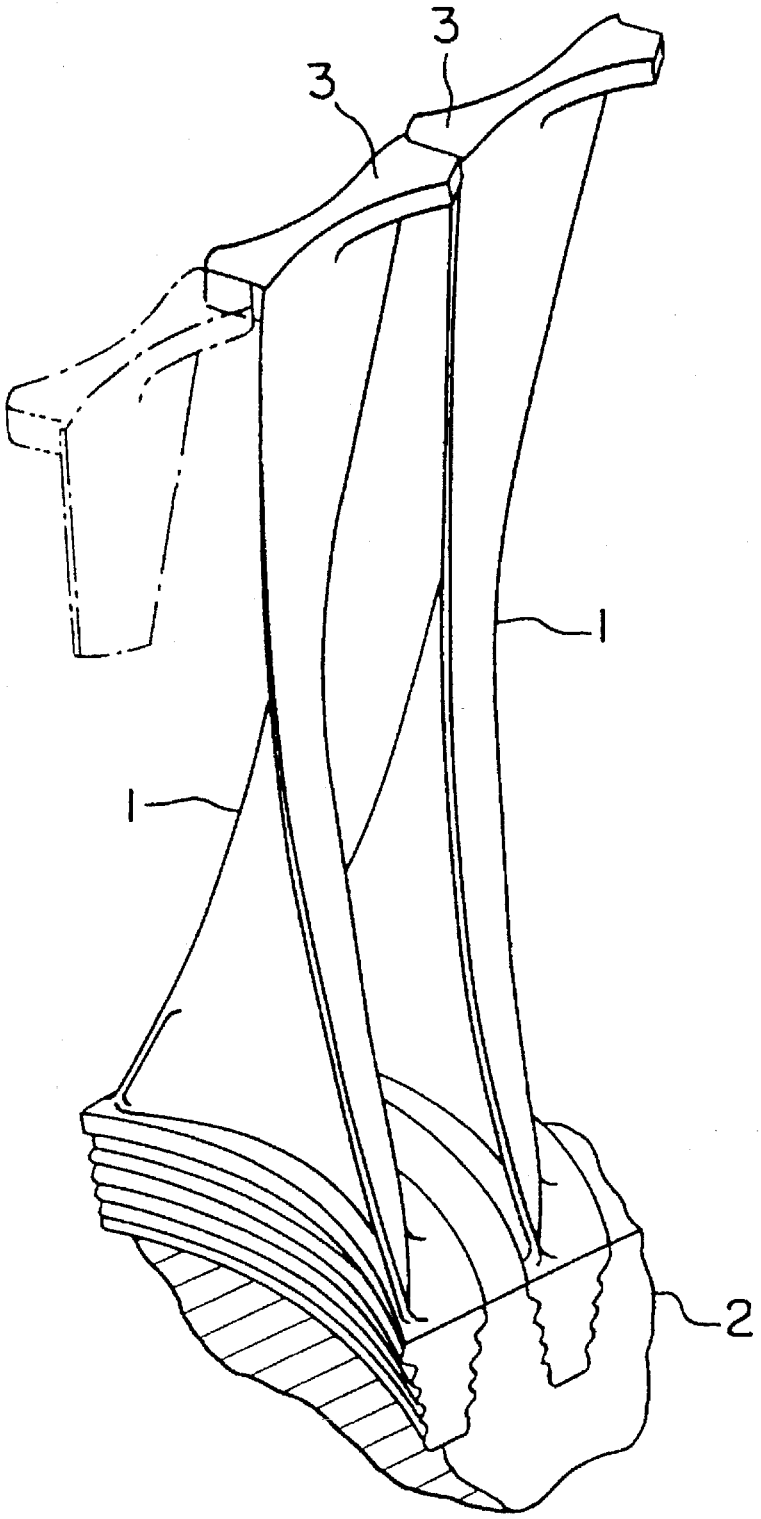
FIG. 15 PRIOR ART
FIG. 15 is a perspective view showing a first example of a prior art blade assembled to a rotor.
Figure 16:
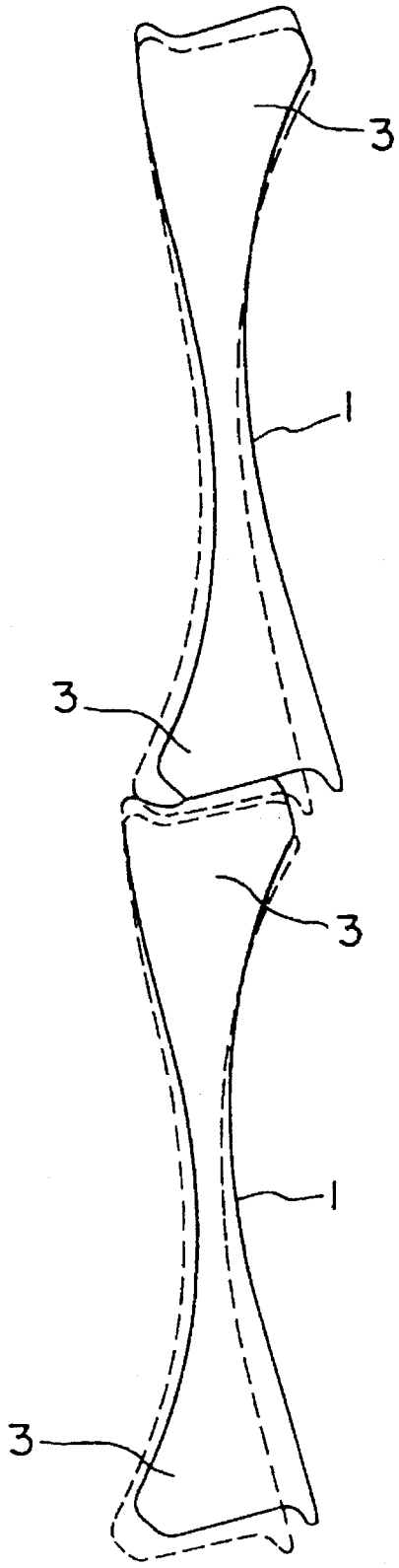
FIG. 16 PRIOR ART
FIG. 16 is an illustration for assistance in explaining the operation of the shrouds of the blades shown in FIG. 15.
Figure 17:
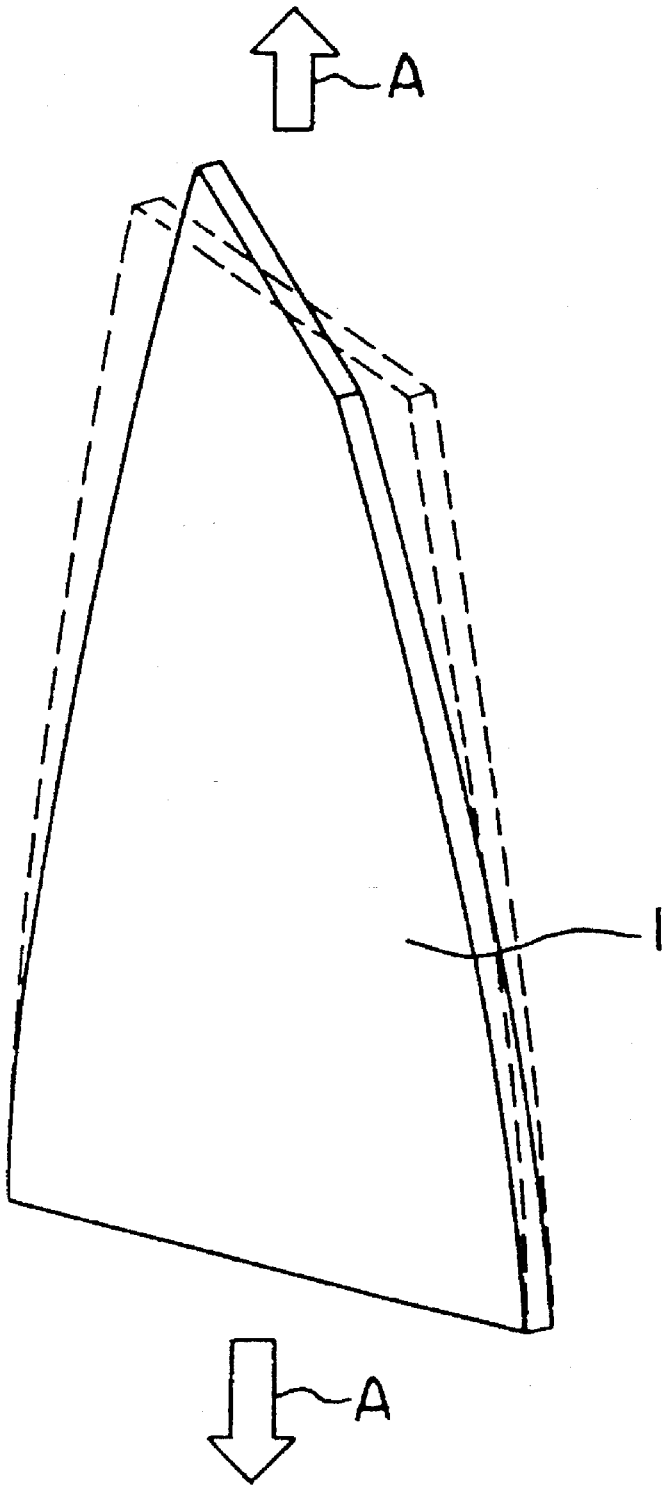
FIG. 17 PRIOR ART
FIG. 17 is an illustration for assistance in explaining a phenomenon of blade untwisting due to centrifugal force applied thereto in the blade shown in FIG. 15.
Figure 18A:
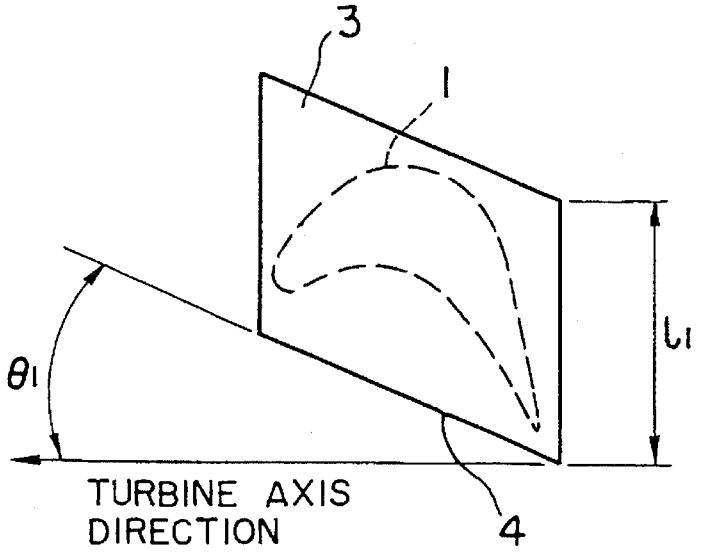
FIG. 18(a) PRIOR ART
FIG. 18(*a*) is an illustration explanatory of a second example of prior art single blade of a snubber structure.
Figure 18B:
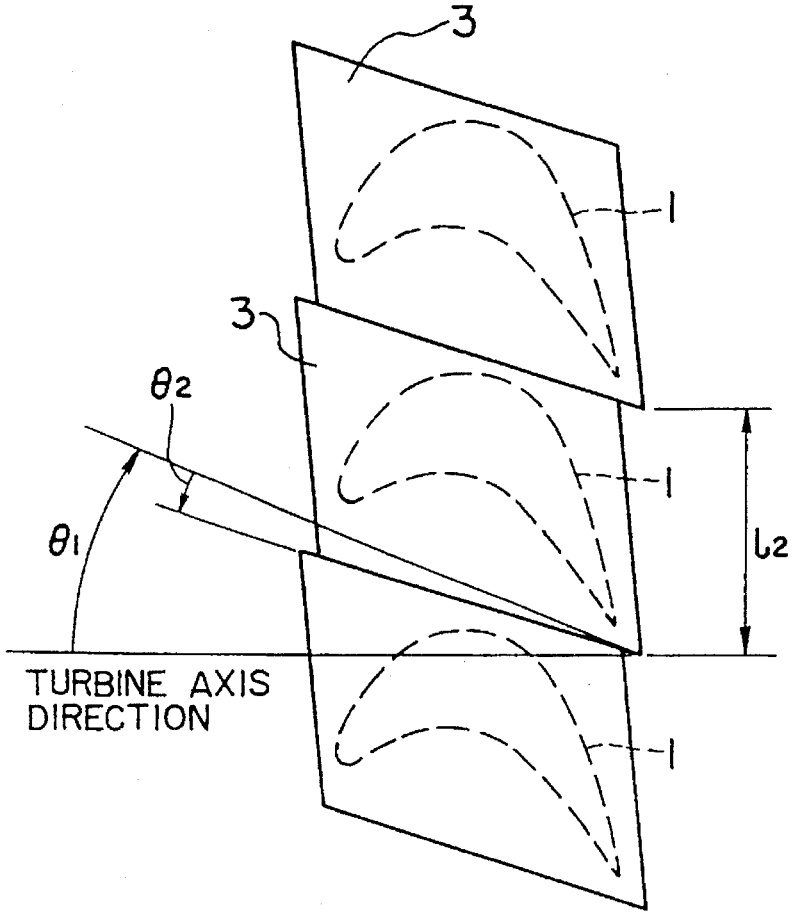
FIG. 18(b) PRIOR ART
Figure 19A:
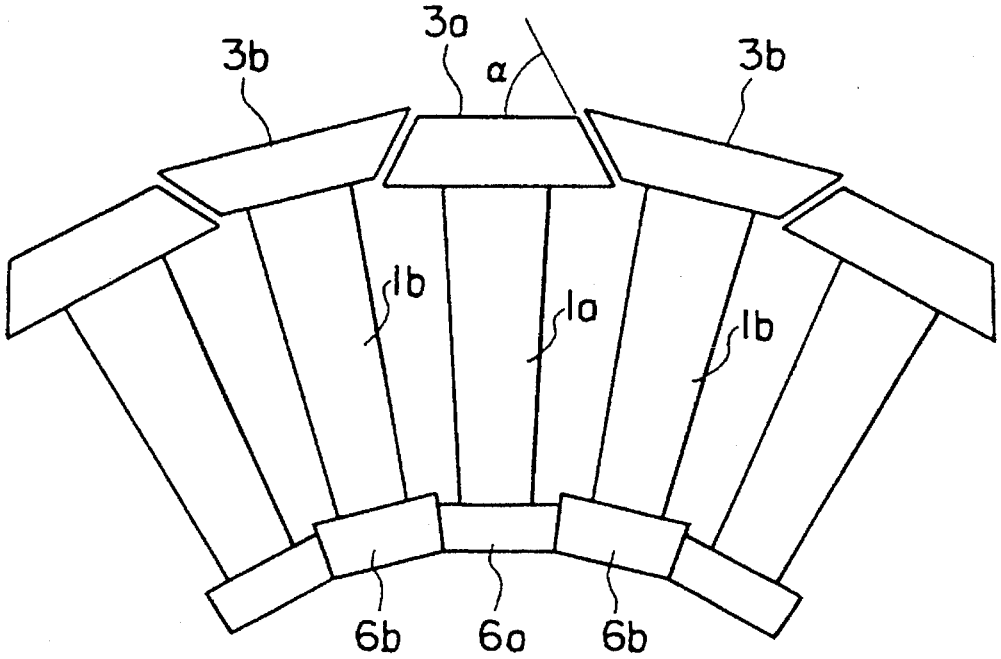
FIG. 19(a) PRIOR ART
FIG. 19(*a*) is a partial front view showing a third example of the prior art blades of snubber structure.
Figure 19B:
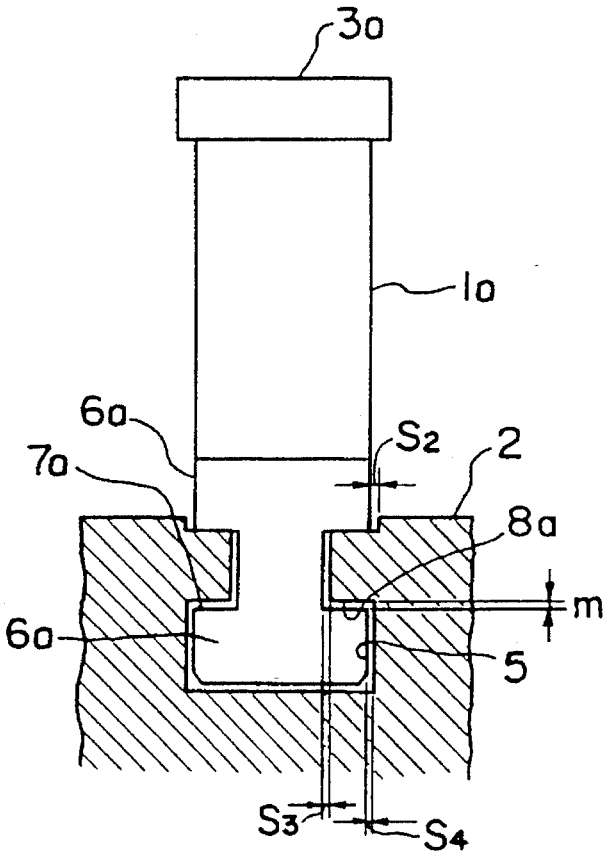
FIG. 19(b) PRIOR ART
Figure 20A:
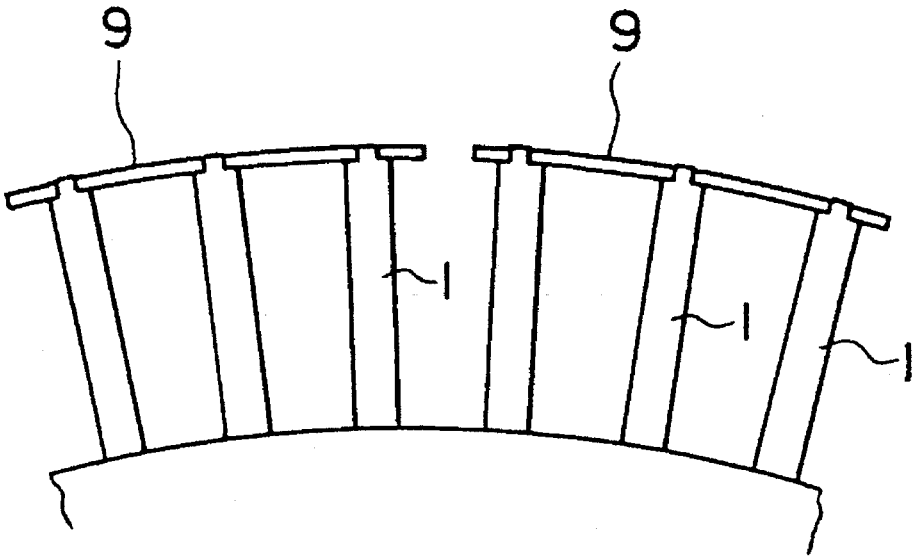
FIG. 20(a) PRIOR ART
FIG. 20 (*a*) is an illustration explanatory of grouped blades obtained by linking a plurality of blades with a rigid blade linking member in the prior art blades.
Figure 20B:
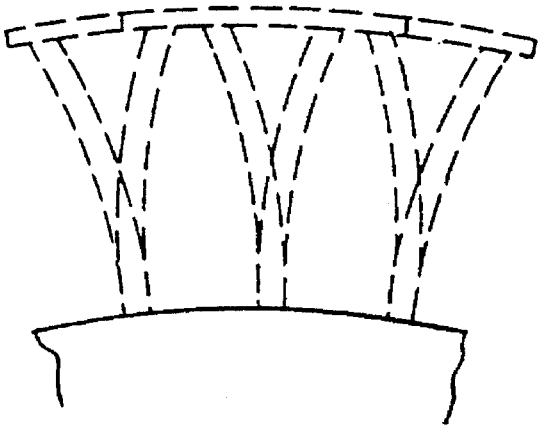
FIG. 20(b) PRIOR ART

FIG. 14 shows a turbine for driving a boiler feed pump, by way of example, to which turbine blades and a dovetail attachment structure according to the present invention are applied. In this case, the same effect as above can be obtained, and the turbine reliability can be improved remarkably.

As described above, in the rotor blade damping structure according to the present invention, it is possible to bring the top shrouds or intermediate boss portions of the blades into surface pressure contact with each other and to maintain a surface pressure contact condition under all turbine operating conditions (such as when the turbine is being accelerated, decelerated, rotated at a rated speed), notwithstanding that the turbine assembly work is easy. Therefore, it is possible to provide reduction of dynamic stress and superior damping properties to the turbine blades under all the operating conditions. In addition, since no excessive stress is applied to the blades during the assembly work and further since all blades can be constructed as continuously coupled blades, it is possible to improve the blade reliability remarkably in addition to the excellent vibration damping properties, with the result that reliability of plants which use the turbine of the structure according to the present invention can be improved.

What is claimed is:

1. A rotor blade damping structure for an axial-flow turbine having blades arranged around a rotor in a turbine circumferential direction, said blades each having a shroud formed integrally therewith at a radially outer end thereof, each of said shrouds having opposite front and rear contact surfaces with respect to a turbine rotational direction, said shrouds being arranged in such a way that shrouds of two adjacent blades are brought into contact with each other at said contact surfaces during rotation, wherein:

at least one of said front contact surface and said rear contact surface of each of the shrouds is formed so as to define an angle with respect to a radial line connecting a rotor center and said one of the contact surfaces;

a cross-section taken in a plane perpendicular to the turbine rotational axis of the shroud of a blade of a first kind is formed in a trapezoidal shape converging radially outward;

a cross-section taken in a plane perpendicular to the turbine rotational axis of the shroud of another blade of a second kind, circumferentially adjacent to said blade of the first kind, is formed in an inverted trapezoidal shape converging radially inward; and half of an angle formed between the front contact surface and the rear contact surface of each of the shrouds is smaller than a static friction angle of the contact surfaces.

2. The rotor blade damping structure of claim 1, wherein the sum of the two pitches between the opposite contact surfaces of the shrouds of two adjacent blades of different kinds is larger than the sum of two geometrical shroud pitches calculated on the basis of a diameter at the shroud contact surfaces and the number of blades.

3. The rotor blade damping structure of claim 1, wherein said shrouds are arranged such that a surface pressure is produced at each of the shroud contact surfaces due to radially outward shifting of the blade of said first kind caused by centrifugal force acting thereon when the rotor is rotated, and further due to a wedge effect produced between the shroud contact surfaces of two adjacent blades.

4. The rotor blade damping structure of claim 1, wherein the rotor has a periphery forming a dovetail attachment extending therealong and projecting radially outward of the rotor, said attachment having a basically dovetail-shaped cross section and having opposite circumferentially continuous grooves on both sides thereof; each of said blades has a dovetail attachment portion substantially complementary to said dovetail attachment and fitting on the dovetail attachment; and opposite outer side walls of said rotor adjacent to said grooves are plastically deformed inward of the rotor axial direction to prevent each of the blades from shifting radially outward under centrifugal force acting thereon as a result of said blades being angularly deflected relative to the rotor axial direction.

5. The rotor blade damping structure of claim 4, wherein the opposite outer side walls of the wheel are plastically deformed by roller pressing so that the blades which have shifted radially outward will not be able to return to original inward positions thereof, and wherein the roller pressing is to be performed before the rotor is submitted to operation at high speed rotation.

6. The rotor blade damping structure of claim 1, wherein each of said dovetail attachment of the rotor has load bearing surfaces for bearing radially outward forces from the associated blade, and a wedge angle of the shroud of the first kind is determined for allowing the blade to be shifted radially outward before the rotor reaches a rated rotational speed so that centrifugal force acting on the blade is received by said load bearing surfaces.

7. The rotor blade damping structure of claim 1, wherein a final blade finally assembled to the rotor is fixed to the rotor by means of a stop pin passed through the final blade and the associated dovetail attachment of the rotor in a rotor axial direction.

8. The rotor blade damping structure of claim 7, wherein the contact surfaces of said final blade are formed along a radial line connecting the rotor center and each of the contact surfaces.

9. The rotor blade damping structure of claim 7, wherein two blades adjacent to the final blade are assembled in such a way that the load bearing surfaces of the dovetail attachment of the rotor are substantially in contact with the associated blade at blade assembly.

10. The rotor blade damping structure of claim 7, wherein a cross-section taken in a plane perpendicular to the turbine rotational axis of the shroud of the final blade is of an inverted trapezoidal shape converging radially inwardly.

11. The rotor blade damping structure of claim 1, wherein when seen in a radial direction of a rotor, the shroud of each of the blades is formed in such a way that front and rear contact surfaces of the shroud are formed to have certain angle with respect to each other; the shroud of one blade is formed into a trapezoidal shape converging frontward of the turbine; and the shroud of another blade adjacent to the blade of the trapezoidal shape is formed in an inverted trapezoidal shape converging rearward of the turbine.

12. The rotor blade damping structure of claim 11, wherein when seen from radial direction of a rotor a half of an angle between the front contact surface and the rear contact surface of the shroud of each blade is smaller than a static frictional angle of the contact surfaces.

13. A rotor blade damping structure for an axial flow turbine having blades arranged around a rotor in the turbine circumferential direction, wherein:

each of said blades is formed with a boss projecting from an intermediate portion on both sides thereof in the turbine circumferential direction, said bosses having opposite front and rear contact surfaces with respect to a turbine rotational direction, said blades being arranged in such a way that bosses of two adjacent blades are brought into contact with each other in said contact surfaces during rotation;

said front side contact surface and said rear side contact surface of the bosses are formed so as to define an angle with respect to a rotor radial line connecting a rotor center and each of the contact surfaces;

a cross-section taken in a plane perpendicular to the turbine rotational axis of the boss of a blade of a first kind is of a trapezoidal shape converging radially outward;

a cross-section taken in a plane perpendicular to the turbine rotational axis of the boss of another blade of a second kind, circumferentially adjacent to said blade of the first kind is of an inverted trapezoidal shape converging radially inward; and a half of an angle formed between the front contact surface and the rear contact surface of each of the bosses is smaller than a static friction angle of the contact surfaces.

* * * * *